US009870849B2

(12) United States Patent
Yoneda

(10) Patent No.: US 9,870,849 B2
(45) Date of Patent: Jan. 16, 2018

(54) CHIP RESISTOR AND MOUNTING STRUCTURE THEREOF

(71) Applicant: ROHM CO., LTD., Kyoto-shi, Kyoto (JP)

(72) Inventor: Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 22 days.

(21) Appl. No.: 15/069,167

(22) Filed: Mar. 14, 2016

(65) Prior Publication Data

US 2016/0196902 A1 Jul. 7, 2016

Related U.S. Application Data

(63) Continuation of application No. 14/323,633, filed on Jul. 3, 2014, now Pat. No. 9,305,685.

(30) Foreign Application Priority Data

Jul. 17, 2013 (JP) ..... 2013-148585

(51) Int. Cl.
*H01C 1/012* (2006.01)

(52) U.S. Cl.
CPC ..... *H01C 1/012* (2013.01)

(58) Field of Classification Search
CPC ..... H01C 1/012; H01C 13/02; H01C 1/142; H01C 17/006; H01C 17/281
USPC ..... 338/307–309
See application file for complete search history.

(56) References Cited

U.S. PATENT DOCUMENTS

| | | | |
|---|---|---|---|
| 6,304,167 | B1 | 10/2001 | Nakayama |
| 6,359,546 | B1 | 3/2002 | Oh |
| 6,727,798 | B2 | 4/2004 | Akhtman et al. |
| 7,330,099 | B2 | 2/2008 | Tsukada |
| 7,667,568 | B2 | 2/2010 | Tanimura et al. |
| 7,782,174 | B2 | 8/2010 | Urano |

(Continued)

FOREIGN PATENT DOCUMENTS

| | | |
|---|---|---|
| JP | 2002-57009 | 2/2002 |
| JP | 2005-277019 A | 10/2005 |

(Continued)

OTHER PUBLICATIONS

Office Action issued in corresponding Japanese Patent application, May 23, 2017, and corresponding English translation.

*Primary Examiner* — Kyung Lee
(74) *Attorney, Agent, or Firm* — Hamre, Schumann, Mueller & Larson, P.C.

(57) ABSTRACT

A chip resistor includes a resistor board, a first electrode, a second electrode and an insulating layer. The second electrode is offset from the first electrode in a lateral direction perpendicular to the thickness direction of the resistor board. The obverse surface of the resistor board includes a first region in contact with the first electrode, a second region in contact with the second electrode and an intermediate region in contact with the insulating layer. The intermediate region is disposed between the first region and the second region in the lateral direction. The first electrode includes a first underlying layer and a first plating layer. The first underlying layer is disposed between the first plating layer and the insulating layer in the thickness direction of the resistor board.

19 Claims, 25 Drawing Sheets

(56) References Cited

U.S. PATENT DOCUMENTS

| | | | | |
|---|---|---|---|---|
| 8,081,059 | B2 * | 12/2011 | Tanimura | H01C 1/148<br>338/307 |
| 8,987,864 | B2 | 3/2015 | Kim et al. | |
| 2009/0002124 | A1 | 1/2009 | Tsai | |
| 2015/0022312 | A1 | 1/2015 | Yoneda | |

FOREIGN PATENT DOCUMENTS

| | | | |
|---|---|---|---|
| JP | 2007-49207 | A | 2/2007 |
| JP | 2013-80875 | A | 5/2013 |
| WO | WO2010/113341 | A1 | 10/2010 |

* cited by examiner

CHIP RESISTOR AND MOUNTING STRUCTURE THEREOF

This application is a Continuation of U.S. Ser. No. 14/323,633, filed Jul. 3, 2014, which applications are incorporated herein by reference.

BACKGROUND OF THE INVENTION

1. Field of the Invention

The present invention relates to a chip resistor and a mounting structure of the chip resistor.

2. Description of the Related Art

Various types of resistors are conventionally known. JPA-2002-57009, for example, discloses a resistor that includes a plate-shaped resistor element and two electrodes. The two electrodes are arranged on the resistor element as spaced apart from each other. In a resistor of this type, the resistance depends on the distance between the two electrodes. To make a resistor having a high resistance, the distance between the two electrodes needs to be increased, which causes each electrode to be made small. When the electrodes are small, however, heat generated in the resistor cannot be efficiently dissipated to the outside.

SUMMARY OF THE INVENTION

The present invention has been proposed under the circumstances described above. It is therefore an object of the present invention to provide a chip resistor that has enhanced heat dissipation efficiency.

According to a first aspect of the present invention, there is provided a chip resistor comprising a resistor board including a resistor board obverse surface, a first electrode, a second electrode and an insulating layer. The second electrode is offset from the first electrode in a second direction opposite to a first direction perpendicular to a thickness direction of the resistor board. The resistor board obverse surface includes a first region in contact with the first electrode, a second region in contact with the second electrode and an intermediate region in contact with the insulating layer. The intermediate region is disposed between the first region and the second region in the first direction. The first electrode includes a first underlying layer and a first plating layer. The first underlying layer is disposed between the first plating layer and the insulating layer in the thickness direction.

Preferably, the first underlying layer is in contact with the insulating layer.

Preferably, each of the first underlying layer and the first plating layer includes a portion that overlaps the intermediate region as viewed in the thickness direction.

Preferably, each of the first underlying layer and the first plating layer includes a portion that overlaps the first region as viewed in the thickness direction.

Preferably, wherein the first plating layer includes a first inner plating film and a first outer plating film. The first inner plating film is disposed between the first outer plating film and the first underlying layer. The first inner plating film is made of Cu, Ag or Au, whereas the first outer plating film is made of Sn.

Preferably, the first plating layer includes a first intermediate plating film, and the first intermediate plating film is disposed between the first inner plating film and the first outer plating film and made of Ni.

Preferably, the first underlying layer is exposed in the first direction.

Preferably, the first underlying layer is made of Ni or Cr.

Preferably, the first underlying layer is smaller in thickness than the insulating layer and the first plating layer.

Preferably, the first underlying layer is formed by sputtering.

Preferably, the first underlying layer is in contact with the first region.

Preferably, the first electrode includes a first electroconductive layer disposed between the first plating layer and the resistor board, and the first electroconductive layer is in contact with the first region.

Preferably, the first electroconductive layer is larger in thickness than the first underlying layer.

Preferably, the first electroconductive layer is exposed in the first direction.

Preferably, the resistor board includes a resistor board first side surface facing in the first direction. The first electrode includes an electrode side surface facing in the first direction. The resistor board first side surface and the electrode side surface are flush with each other.

Preferably, the first electrode includes a first electrode obverse surface and a first curved surface. The first electrode obverse surface and the resistor board obverse surface face in a same direction. The first curved surface connects the first electrode obverse surface and the electrode side surface to each other.

Preferably, the resistor board includes a resistor board first end surface facing in a third direction perpendicular to both of the first direction and the thickness direction. The first electrode includes an electrode first end surface facing in the third direction. The resistor board first end surface and the electrode first end surface are flush with each other.

Preferably, the resistor board includes a resistor board second end surface facing in a fourth direction opposite to the third direction. The first electrode includes an electrode second end surface facing the in the fourth direction. The resistor board second end surface and the electrode second end surface are flush with each other.

Preferably, the second electrode includes a second underlying layer and a second plating layer. The second underlying layer is disposed between the second plating layer and the insulating layer in the thickness direction.

Preferably, the second underlying layer is in contact with the insulating layer.

Preferably, each of the second underlying layer and the second plating layer includes a portion that overlaps the intermediate region as viewed in the thickness direction.

Preferably, each of the second underlying layer and the second plating layer includes a portion that overlaps the second region as viewed in the thickness direction.

Preferably, the second plating layer includes a second inner plating film and a second outer plating film. The second inner plating film is disposed between the second outer plating film and the second underlying layer. The second inner plating film is made of Cu, Ag or Au, whereas the second outer plating film is made of Sn.

Preferably, the second plating layer includes a second intermediate plating film. The second intermediate plating film is disposed between the second inner plating film and the second outer plating film and made of Ni.

Preferably, the second underlying layer is exposed in the second direction.

Preferably, the second underlying layer is made of Ni or Cr.

Preferably, the second underlying layer is smaller in thickness than the insulating layer and the second plating layer.

Preferably, the second underlying layer is formed by sputtering.

Preferably, the resistor board includes a resistor board reverse surface. The resistor board obverse surface and the resistor board reverse surface face in mutually opposite directions. The chip resistor further comprises a protective layer covering the resistor board reverse surface.

Preferably, the resistor board is made of manganin, zeranin, Ni—Cr alloy, Cu—Ni alloy or Fe—Cr alloy.

Preferably, the insulating layer includes an insulating layer obverse surface, and the first electrode and the second electrode are formed on the insulating layer obverse surface.

Preferably, the insulating layer has a thermal conductivity of 1.0 to 5.0 W/(m·K).

According to a second aspect of the present invention, there is provided a chip resistor mounting structure comprising the chip resistor according to the first aspect of the present invention, a mount board on which the chip resistor is mounted, and an electroconductive bonding portion disposed between the mount board and the chip resistor.

Other features and advantages of the present invention will become more apparent from detailed description given below with reference to the accompanying drawings.

DESCRIPTION OF THE PREFERRED EMBODIMENTS

A first embodiment of the present invention is described below with reference to FIGS. 1-18.

Figure 1:
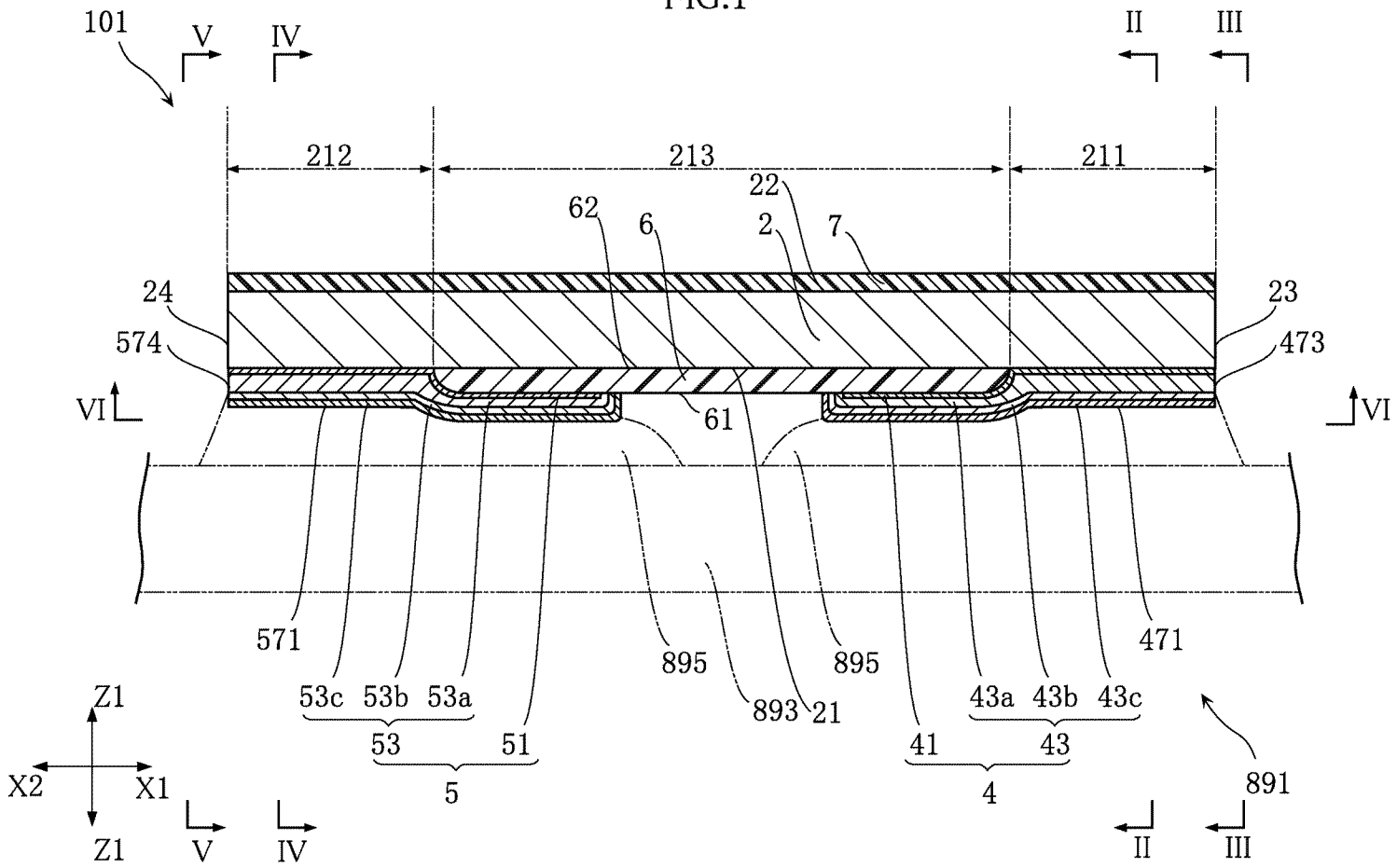
FIG. 1 is a sectional view illustrating a mounting structure of a chip resistor according to a first embodiment of the present invention.

FIG. 1 is a sectional view illustrating a mounting structure of a chip resistor according to a first embodiment of the present invention.

The chip resistor mounting structure 891 illustrated in the figure includes a chip resistor 101, a mount board 893 and an electroconductive bonding portion 895.

For instance, the mount board 893 is a printed circuit board including an insulating substrate and a pattern electrode (not shown) formed on the insulating substrate. For instance, the insulating substrate is a glass epoxy resin substrate. The chip resistor 101 is mounted on the mount board 893. The electroconductive bonding portion 895 is provided between the chip resistor 101 and the mount board 893. The electroconductive bonding portion 895 bonds the chip resistor 101 and the mount board 893 to each other. For instance, the electroconductive bonding portion 895 comprises solder.

Figure 2:
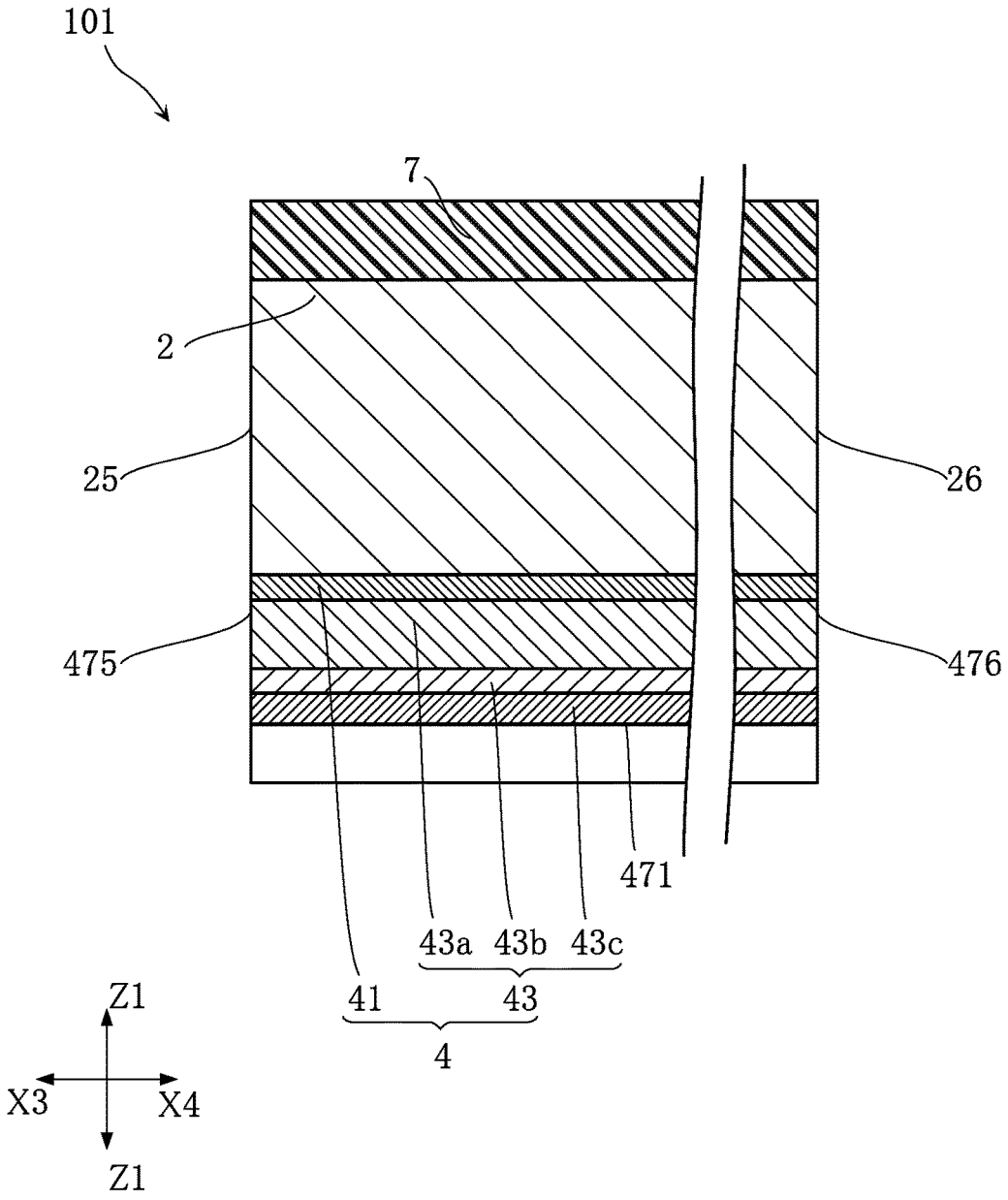
FIG. 2 is a sectional view of the chip resistor taken along lines II-II in FIG. 1.
Figure 3:
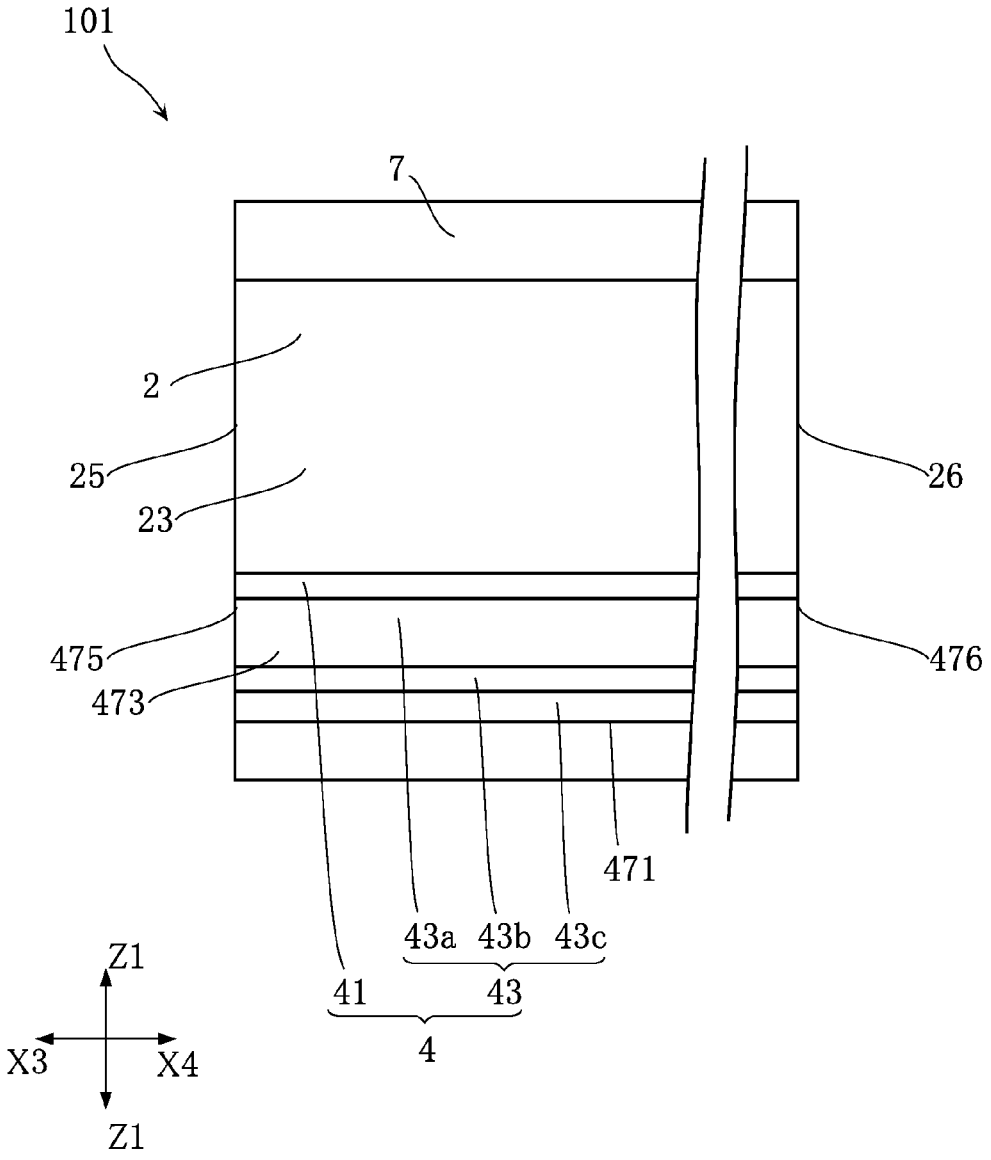
FIG. 3 illustrates the chip resistor as seen in the direction of arrows III-III in FIG. 1.
Figure 4:
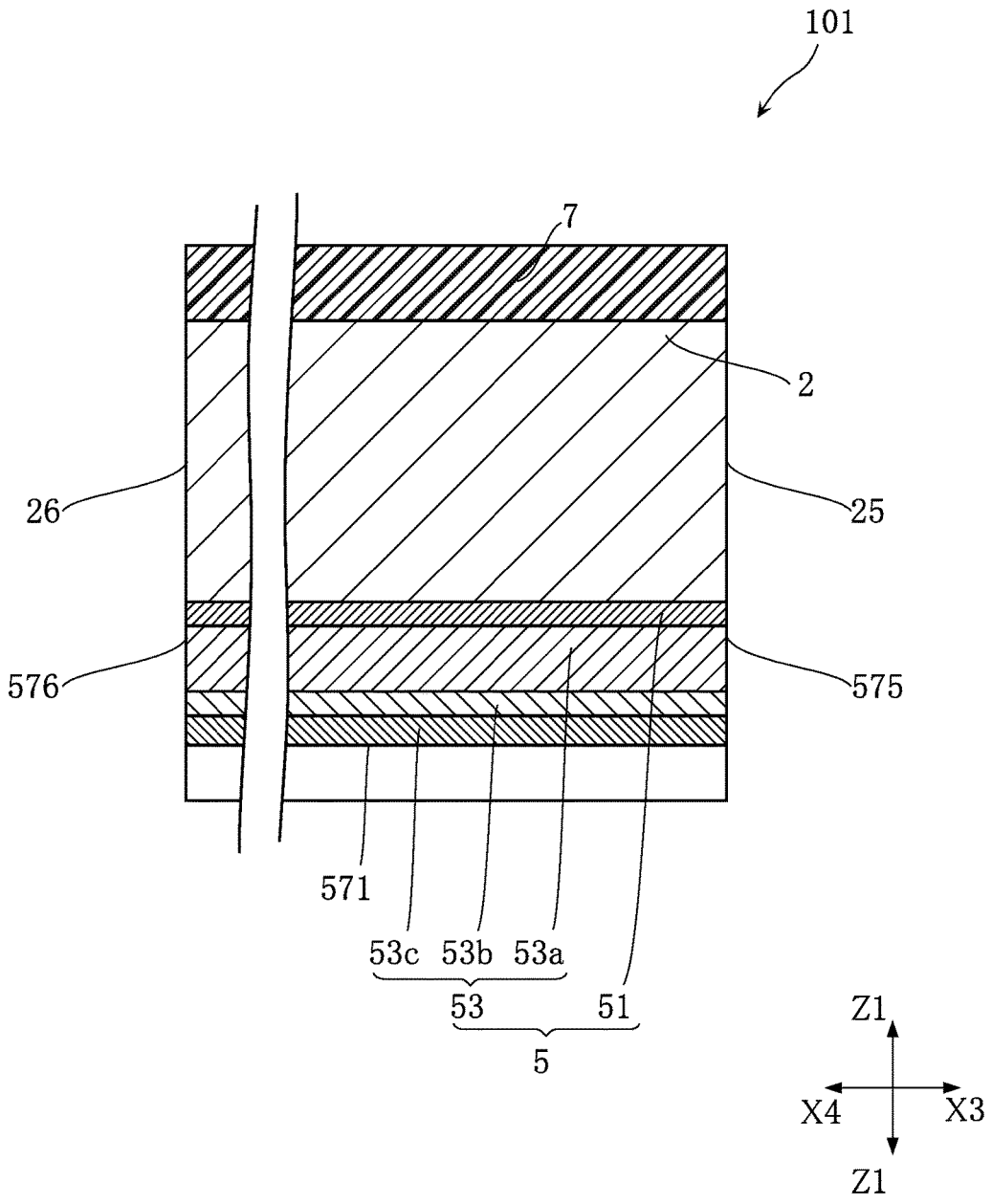
FIG. 4 is a sectional view of the chip resistor taken along lines IV-IV in FIG. 1.
Figure 5:
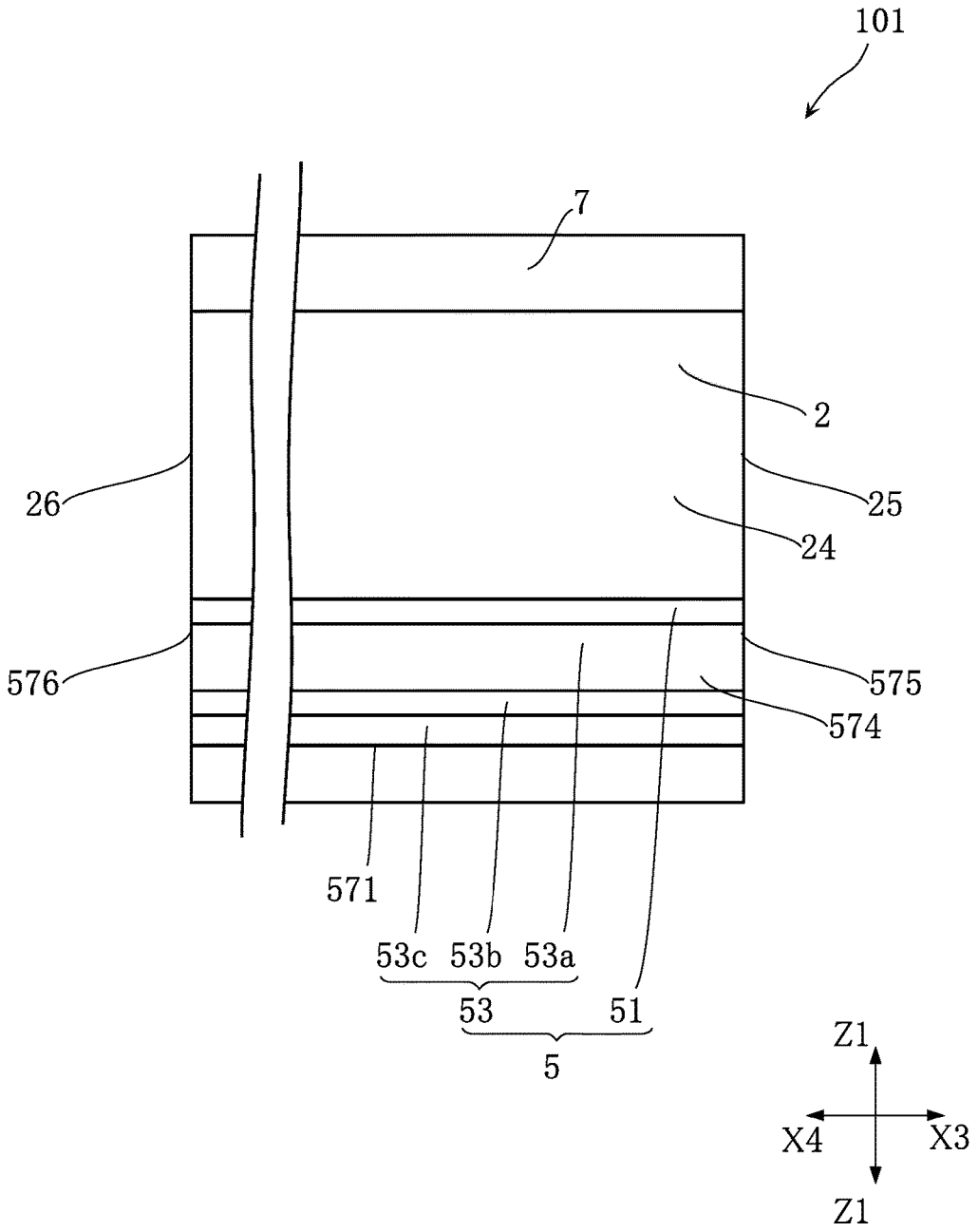
FIG. 5 illustrates the chip resistor as seen in the direction of arrows V-V in FIG. 1.
Figure 6:
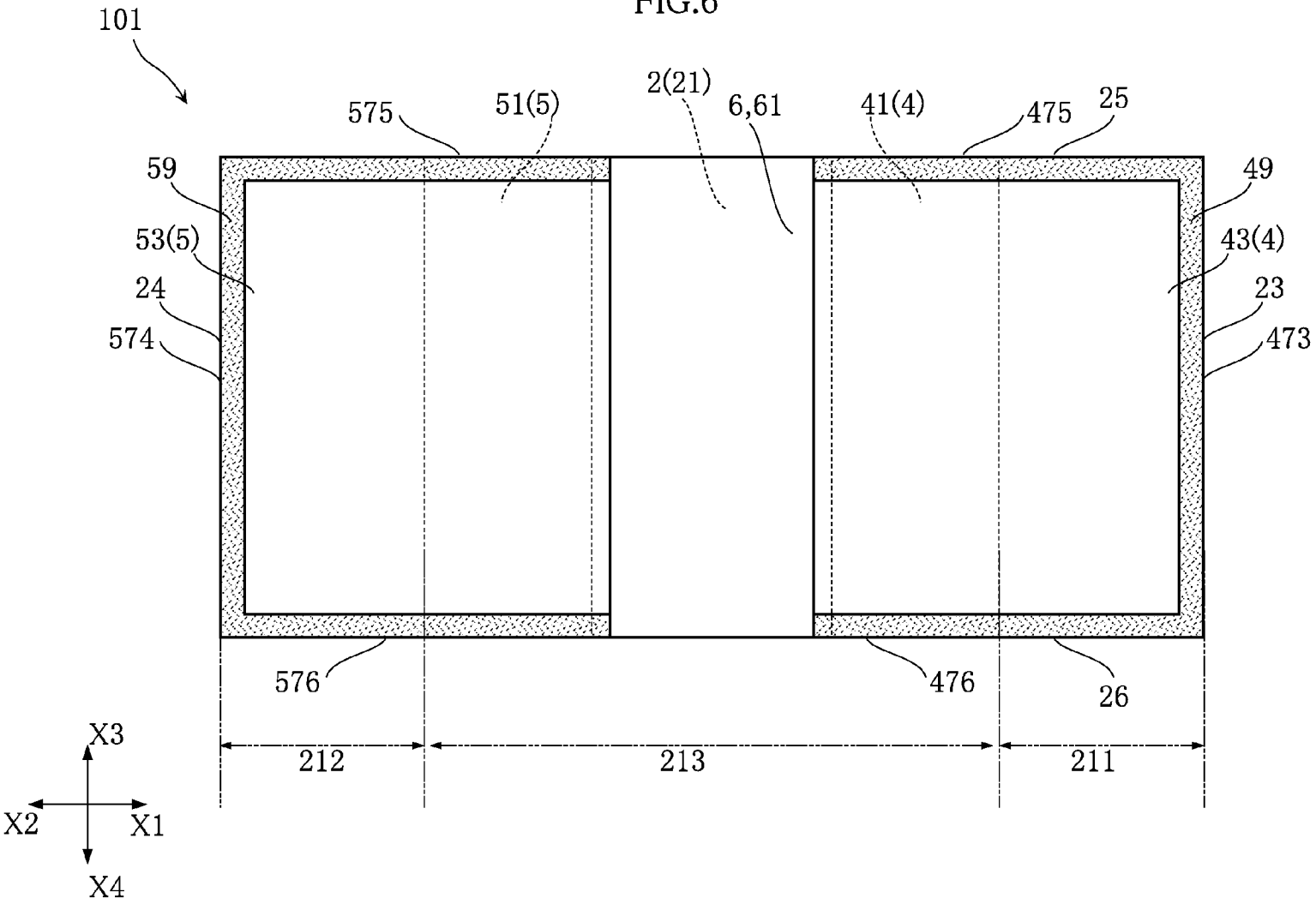
FIG. 6 is a partially seen-through view of the chip resistor as seen in the direction of arrows VI-VI in FIG. 1.

FIG. 2 is a sectional view of the chip resistor taken along lines II-II in FIG. 1. FIG. 3 illustrates the chip resistor as seen in the direction of arrows III-III in FIG. 1. FIG. 4 is a sectional view of the chip resistor taken along lines IV-IV in FIG. 1. FIG. 5 illustrates the chip resistor as seen in the direction of arrows V-V in FIG. 1. FIG. 6 is a partially seen-through view of the chip resistor as seen in the direction of arrows VI-VI in FIG. 1.

The chip resistor 101 illustrated in these figures includes a resistor board 2, a first electrode 4, a second electrode 5, an insulating layer 6 and a protective layer 7.

The resistor board 2 has a plate-like shape. The resistor board 2 is made of a resistive metal material. Examples of the resistive metal material include manganin, zeranin, Ni—Cr alloy, Cu—Ni alloy and Fe—Cr alloy.

As illustrated in FIGS. 1-7, the resistor board 2 has a resistor board obverse surface 21, a resistor board reverse surface 22, a resistor board first side surface 23, a resistor board second side surface 24, a resistor board first end surface 25 and a resistor board second end surface 26.

All of the resistor board obverse surface 21, the resistor board reverse surface 22, the resistor board first side surface 23, the resistor board second side surface 24, the resistor board first end surface 25 and the resistor board second end surface 26 are flat. Referring to FIG. 1, the up-down direction in the figure is defined as the "thickness direction" Z1 of the resistor board 2. In FIG. 6, the "first direction" X1 runs to the right, and the "second direction" X2 runs to the left. Further, the "third direction" X3 runs upwards, and the "fourth direction" X4 runs downwards. The maximum thickness (maximum size in thickness direction Z1) of the resistor board 2 is e.g. 130 to 300 μm. The thickness direction Z1 is perpendicular to each of the first direction X1, the second direction X2, the third direction X3 and the fourth direction X4. In addition, each of the first direction X1 and the second direction X2 is perpendicular to the third direction X3 and the fourth direction X4.

For instance, the dimension of the chip resistor 101 in the first direction X1 is about 1.0 to 6.4 mm, and the dimension of the chip resistor 101 in the third direction X3 is 0.5 to 3.2 mm.

The resistor board obverse surface 21 and the resistor board reverse surface 22 face in mutually opposite directions. The resistor board first side surface 23 faces in the first direction X1. The resistor board second side surface 24 faces in the second direction X2. That is, the resistor board first side surface 23 and the resistor board second side surface 24 face in mutually opposite directions. The resistor board first end surface 25 faces in the third direction X3. The resistor board second end surface 26 faces in the fourth direction X4. That is, the resistor board first end surface 25 and the resistor board second end surface 26 face in mutually opposite directions.

As illustrated in FIGS. 1 and 6, the resistor board obverse surface 21 includes a first region 211, a second region 212 and an intermediate region 213.

The first region 211 is the region that is in contact with the first electrode 4. The second region 212 is the region that is in contact with the second electrode 5. The intermediate region 213 is the region that is in contact with the insulating layer 6. In this embodiment, all of the first region 211, the second region 212 and the intermediate region 213 are rectangular. The first region 211 is connected to the resistor board first side surface 23, the resistor board first end surface 25 and the resistor board second end surface 26. The second region 212 is connected to the resistor board second side surface 24, the resistor board first end surface 25 and the resistor board second end surface 26. The intermediate region 213 is connected to the resistor board first end surface 25 and the resistor board second end surface 26. The intermediate region 213 is disposed between the first region 211 and the second region 212 in the first direction X1. The intermediate region 213 and the first region 211 are connected to each other. The intermediate region 213 and the second region 212 are connected to each other.

The insulating layer 6 is formed on the resistor board 2. The insulating layer 6 is in contact with the resistor board obverse surface 21 of the resistor board 2. The insulating layer 6 is made of a material containing e.g. epoxy-based resin or polyimide. The dimension of the insulating layer 6 in the first direction X1 is equal to the dimension of the intermediate region 213 of the resistor board obverse surface 21 in the first direction X1. The dimension of the insulating layer 6 in the third direction X3 is equal to the dimension of the resistor board 2 in the third direction X3. The maximum thickness of the insulating layer 6 (maximum dimension in the thickness direction Z1) is e.g. 20-40 μm. In order that the heat generated in the resistor board 2 is efficiently dissipated to the outside of the chip resistor 101, it is preferable that the insulating layer 6 is made of a material having a high thermal conductivity. Moreover, to enhance the thermal conductivity, it is preferable that the insulating layer 6 contains a thermally conductive filler. Examples of such a filler include alumina. It is preferable that the thermal conductivity of the insulating layer 6 is higher than that of the material forming the resistor board 2. It is preferable that the thermal conductivity of the insulating layer 6 is e.g. 1.0 to 5.0 W/(m·K).

The insulating layer 6 has an insulating layer obverse surface 61 and an insulating layer reverse surface 62.

The insulating layer obverse surface 61 generally faces away from the resistor board 2 (i.e., faces downward in FIG. 1). The first electrode 4 and the second electrode 5 are formed on the insulating layer obverse surface 61. A part of the insulating layer obverse surface 61 (the region sandwiched between the first electrode 4 and the second electrode) is exposed from the first electrode 4 and the second electrode 5.

The insulating layer reverse surface 62 faces in the same direction as the resistor board reverse surface 22 (i.e., faces upward in FIG. 1). In this embodiment, the insulating layer reverse surface 62 is in contact with the resistor board 2. Specifically, the insulating layer reverse surface 62 is in contact with the resistor board obverse surface 21.

The first electrode 4 is electrically connected to the resistor board 2. The first electrode 4 is used to supply electric power to the resistor board 2 from the mount board 893 on which the chip resistor 101 is mounted. The first electrode 4 is in contact with the resistor board 2 and the insulating layer 6. In this embodiment, the first electrode 4 is in contact with the resistor board obverse surface 21 of the resistor board 2. In this embodiment, a part of the insulating layer 6 is disposed between the first electrode 4 and the resistor board 2. As illustrated in FIG. 1, in the mounting structure 891, the first electrode 4 is in contact with the electroconductive bonding portion 895 and electrically connected to a wiring pattern (not shown) of the mount board 893 via the electroconductive bonding portion 895.

The first electrode 4 includes a first underlying layer 41 and a first plating layer 43.

Figure 7:
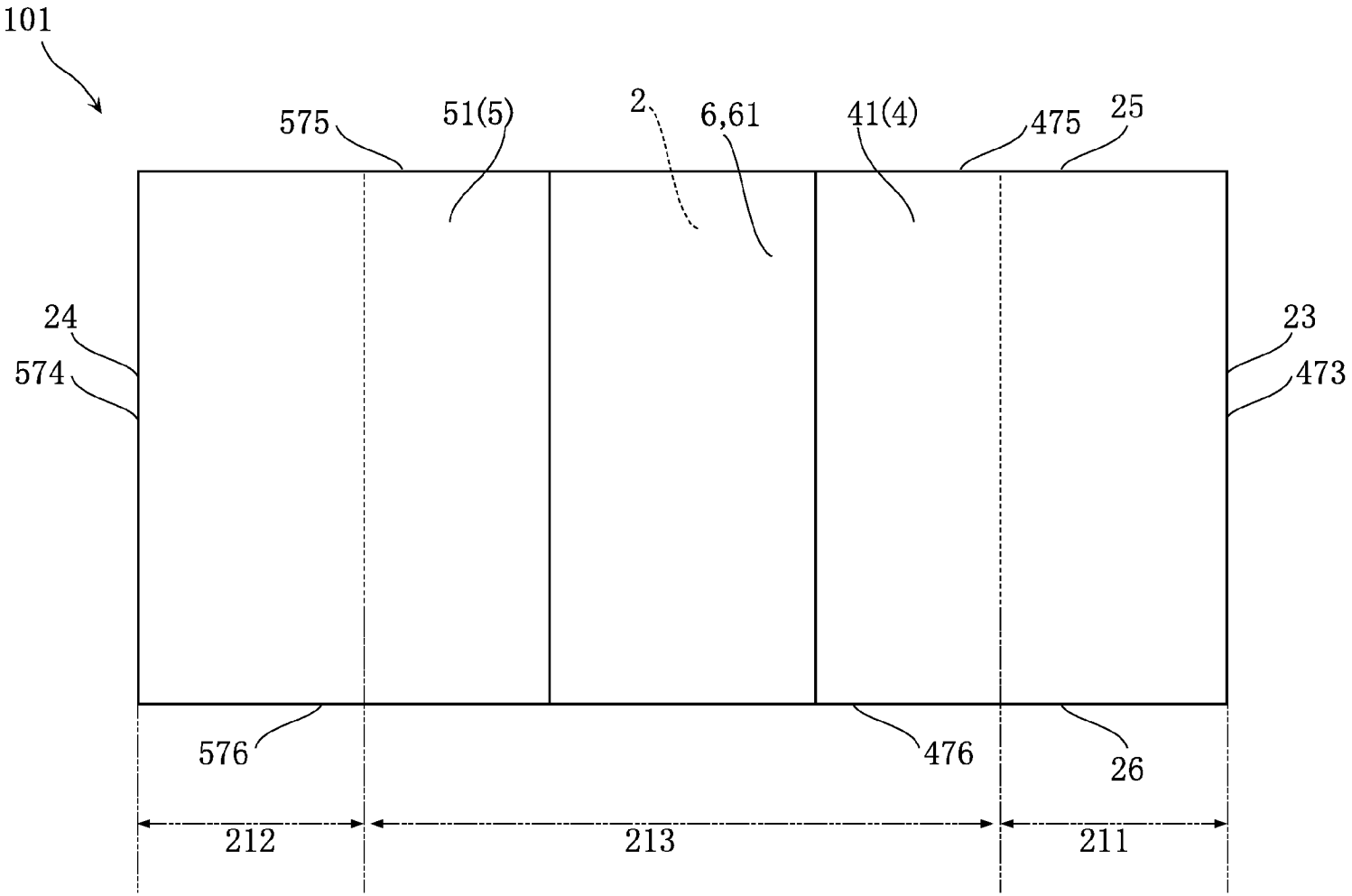
FIG. 7 is a view obtained by omitting the first plating layer and the second plating layer from FIG. 6.

FIG. 7 is a view obtained by omitting the first plating layer and the second plating layer from FIG. 6.

As illustrated in FIGS. 1 and 7, the first underlying layer 41 is in contact with the resistor board 2. The first underlying layer 41 serves as the base for forming the first plated layer 43 on the insulating layer 6 by a plating method. The first underlying layer 41 is in contact with a portion of the resistor board obverse surface 21 which is exposed from the insulating layer 6. The first underlying layer 41 includes a portion spaced apart from the resistor board 2 in the thickness direction Z1. In the thickness direction Z1, the first underlying layer 41 is disposed between the first plating layer 43 and the insulating layer 6. The insulating layer 6 is disposed between the first underlying layer 41 and the resistor board 2. The first underlying layer 41 includes a portion that overlaps the first region 211 and the intermediate region 213 as viewed in the thickness direction Z1. In this embodiment, the first underlying layer 41 is in contact with the first region 211.

As shown in FIGS. 1-3, the side surfaces of the first underlying layer 41 are exposed. That is, in the chip resistor 101, the first underlying layer 41 is exposed in the first direction X1, the third direction X3 and the fourth direction X4.

In order that the chip resistor 101 has good heat dissipation efficiency, it is preferable that the dimension of the first underlying layer 41 in the first direction X1 is large. Preferably, the dimension of the first underlying layer 41 in the first direction X1 is not smaller than one fourth of the dimension of the resistor board 2 in the first direction X1 and more preferably not smaller than one third of the dimension of the resistor board 2 in the first direction X1. The thickness of the first underlying layer 41 is smaller than the thicknesses of the insulating layer 6 and the first plating layer 43. The first underlying layer 41 can be formed by PVD (Physical Vapor Deposition), CVD (Chemical Vapor Deposition) or printing. In this embodiment, the first underlying layer 41 is formed by PVD, in particular by sputtering. The first underlying layer 41 is e.g. 100 to 500 nm in thickness. For instance, the first underlying layer 41 contains Ni or Cr.

The first plating layer 43 directly covers the first underlying layer 41. The first plating layer 43 is formed on the resistor board 2. A part of the first plating layer 43 is in contact with the insulating layer 6. The first plating layer 43 is in contact with a portion of the insulating layer 6 which is offset from the first underlying layer 41 in the second direction X2. Before the chip resistor 101 is mounted on the mount board 893, the first plating layer 43 is exposed to the outside. As illustrated in FIG. 1, in the mounting structure 891, the first plating layer 43 is in contact with the electroconductive bonding portion 895 and electrically connected to the wiring pattern (not shown) of the mount board 893 via the electroconductive bonding portion 395.

The first plating layer 43 includes a first inner plating film 43*a* and a first outer plating film 43*c*.

For instance, the first inner plating film 43*a* is Cu, Ag or Au. The first inner plating film 43*a* directly covers the first underlying layer 41. The first outer plating film 43*c* is formed on the first inner plating film 43*a*. In mounting the chip resistor 101, solder (electroconductive bonding portion 895) adheres to the first outer plating film 43*c*. For instance, the first outer plating film 43*c* is Sn.

In this embodiment, the first plating layer 43 includes a first intermediate plating film 43*b*. The first intermediate plating film 43*b* is disposed between the first inner plating film 43*a* and the first outer plating film 43*c*. For instance, the first intermediate plating film 43*b* is Ni. Unlike this embodiment, the first plating layer 43 may not include a first intermediate plating film 43*b*, and the first inner plating film 43*a* and the first outer plating film 43*c* may be in direct contact with each other.

For instance, the first inner plating film 43*a* is 10 to 50 μm in thickness, the first intermediate plating film 43*b* is 1 to 10 μm in thickness and the first outer plating film 43*c* is 1 to 10 μm in thickness.

Figure 8:
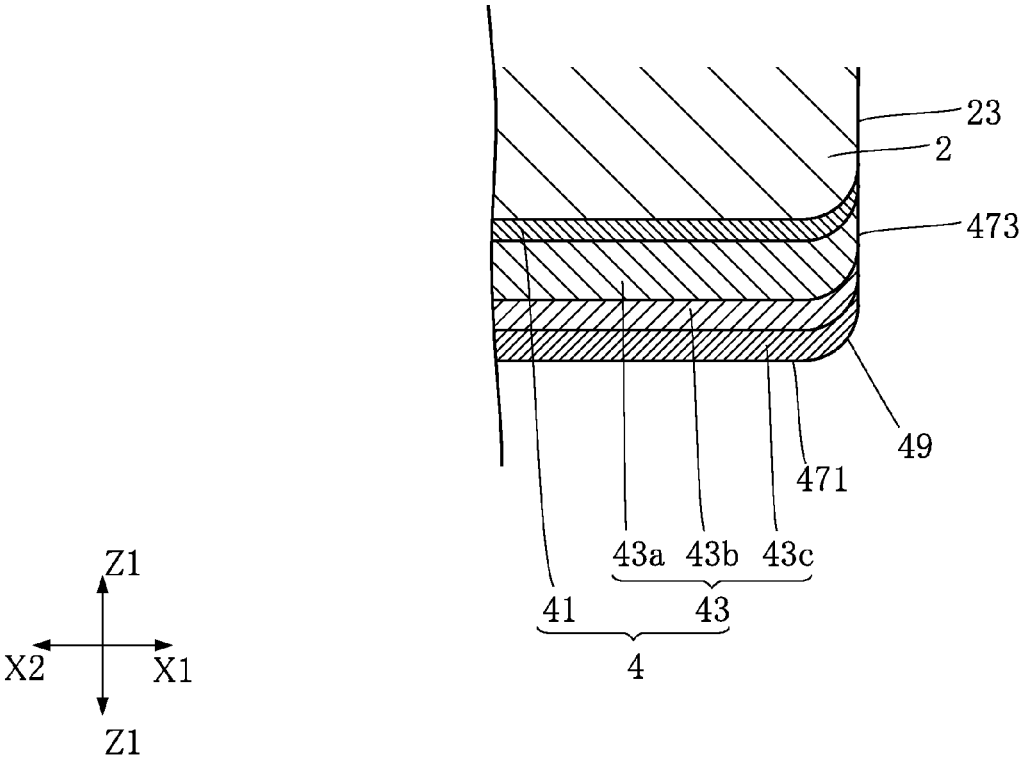
FIG. 8 illustrates a part of the chip resistor of FIG. 1 as enlarged.

FIG. 8 illustrates a portion of the chip resistor 101 of FIG. 1 as enlarged.

As illustrated in FIGS. 1-3 and FIGS. 6-8, the first electrode 4 has a first electrode obverse surface 471, an electrode side surface 473, an electrode end surface 475 (electrode first end surface), an electrode end surface 476 (electrode second end surface) and a first curved surface 49 (see FIG. 8). Illustration of the first curved surface 49 is omitted in the figures other than FIGS. 6 and 8.

The first electrode obverse surface 471 faces in the same direction as the resistor board obverse surface 21 (i.e., downward in FIG. 1). The first electrode obverse surface 471 is provided by the first plating layer 43 and specifically by the first outer plating film 43*c*.

The electrode side surface 473 faces in the first direction X1. In this embodiment, the electrode side surface 473 is flush with the resistor board first side surface 23. As illustrated in FIGS. 2 and 3, the electrode end surface 475 faces in the third direction X3. The electrode end surface 475 is flush with the resistor board first end surface 25. The electrode end surface 476 faces in the fourth direction X4. The electrode end surface 476 is flush with the resistor board second end surface 26. The electrode side surface 473, the electrode end surface 475 and the electrode end surface 476 are provided by the first underlying layer 41 and the first plating layer 43, and specifically provided by the first underlying layer 41, the first inner plating film 43*a*, the first intermediate plating film 43*b* and the first outer plating film 43*c*.

As illustrated in FIG. 8, the first curved surface 49 is formed at the edges as viewed in the thickness direction Z1. In FIG. 6, the portions where the first curved surface 49 is formed are shaded. The first curved surface 49 is connected to the first electrode obverse surface 471, the electrode side surface 473, the electrode end surface 475 and the electrode end surface 476. The first curved surface 49 is formed because punching is employed to make the chip resistor 101.

The second electrode 5 is offset from the first electrode 4 in the second direction X2. The second electrode 5 is spaced apart from the first electrode 4. The second electrode 5 is electrically connected to the resistor board 2. The second electrode 5 is used to supply electric power to the resistor board 2 from the mount board 893 on which the chip resistor 101 is mounted. The second electrode 5 is in contact with the resistor board 2 and the insulating layer 6. In this embodiment, the second electrode 5 is in contact with the resistor board obverse surface 21 of the resistor board 2. In this embodiment, a part of the insulating layer 6 is disposed between the second electrode 5 and the resistor board 2. As illustrated in FIG. 1, in the mounting structure 891, the second electrode 5 is in contact with the electroconductive bonding portion 895 and electrically connected to a wiring pattern (not shown) of the mount board 893 via the electroconductive bonding portion 895.

The second electrode 5 includes a second underlying layer 51 and a second plating layer 53.

The second underlying layer 51 is in contact with the resistor board 2. The second underlying layer 51 serves as the base for forming the second plated layer 53 on the insulating layer 6 by a plating method. The second underlying layer 51 is in contact with a portion of the resistor board obverse surface 21 which is exposed from the insulating layer 6. The second underlying layer 51 includes a portion spaced apart from the resistor board 2 in the thickness direction Z1. In the thickness direction Z1, the second underlying layer 51 is disposed between the second plating layer 53 and the insulating layer 6. The insulating layer 6 is disposed between the second underlying layer 51 and the resistor board 2. The second underlying layer 51 includes a portion that overlaps the second region 212 and the intermediate region 213 as viewed in the thickness direction Z1. In this embodiment, the second underlying layer 51 is in contact with the second region 212.

As shown in FIGS. 1, 4 and 5, the side surfaces of the second underlying layer 51 are exposed. That is, in the chip resistor 101, the second underlying layer 51 is exposed in the second direction X2, the third direction X3 and the fourth direction X4.

In order that the chip resistor 101 has good heat dissipation efficiency, it is preferable that the dimension of the second underlying layer 51 in the second direction X2 is large. Preferably, the dimension of the second underlying layer 51 in the second direction X2 is not smaller than one fourth of the dimension of the resistor board 2 in the second direction X2 and more preferably not smaller than one third of the dimension of the resistor board 2 in the second direction X2. The thickness of the second underlying layer 51 is smaller than the thicknesses of the insulating layer 6 and the second plating layer 53. The second underlying layer 51 can be formed by PVD (Physical Vapor Deposition), CVD (Chemical Vapor Deposition) or printing. In this embodiment, the second underlying layer 51 is formed by PVD, in particular by sputtering. The second underlying layer 51 is e.g. 100 to 500 nm in thickness. For instance, the second underlying layer 51 contains Ni or Cr.

The second plating layer 53 directly covers the second underlying layer 51. The second plating layer 53 is formed on the resistor board 2. A part of the second plating layer 53 is in contact with the insulating layer 6. The second plating layer 53 is in contact with a portion of the insulating layer 6 which is offset from the second underlying layer 51 in the first direction X1. Before the chip resistor 101 is mounted on the mount board 893, the second plating layer 53 is exposed to the outside. As illustrated in FIG. 1, in the mounting structure 891, the second plating layer 53 is in contact with the electroconductive bonding portion 895 and electrically connected to the wiring pattern (not shown) of the mount board 893 via the electroconductive bonding portion 895.

The second plating layer 53 includes a second inner plating film 53*a* and a second outer plating film 53*c*.

For instance, the second inner plating film 53*a* is Cu, Ag or Au. The second inner plating film 53*a* directly covers the second underlying layer 51. The second outer plating film 53*c* is formed on the second inner plating film 53*a*. In mounting the chip resistor 101, solder (electroconductive bonding portion 895) adheres to the second outer plating film 53*c*. For instance, the second outer plating film 53*c* is Sn.

In this embodiment, the second plating layer 53 includes a second intermediate plating film 53*b*. The second intermediate plating film 53*b* is disposed between the second inner plating film 53*a* and the second outer plating film 53*c*. For instance, the second intermediate plating film 53*b* is Ni. Unlike this embodiment, the second plating layer 53 may not include a second intermediate plating film 53*b*, and the second inner plating film 53*a* and the second outer plating film 53*c* may be in direct contact with each other.

For instance, the second inner plating film 53*a* is 10 to 50 μm in thickness, the second intermediate plating film 53*b* is 1 to 10 μm in thickness, and the second outer plating film 53*c* is 1 to 10 μm in thickness.

Figure 9:
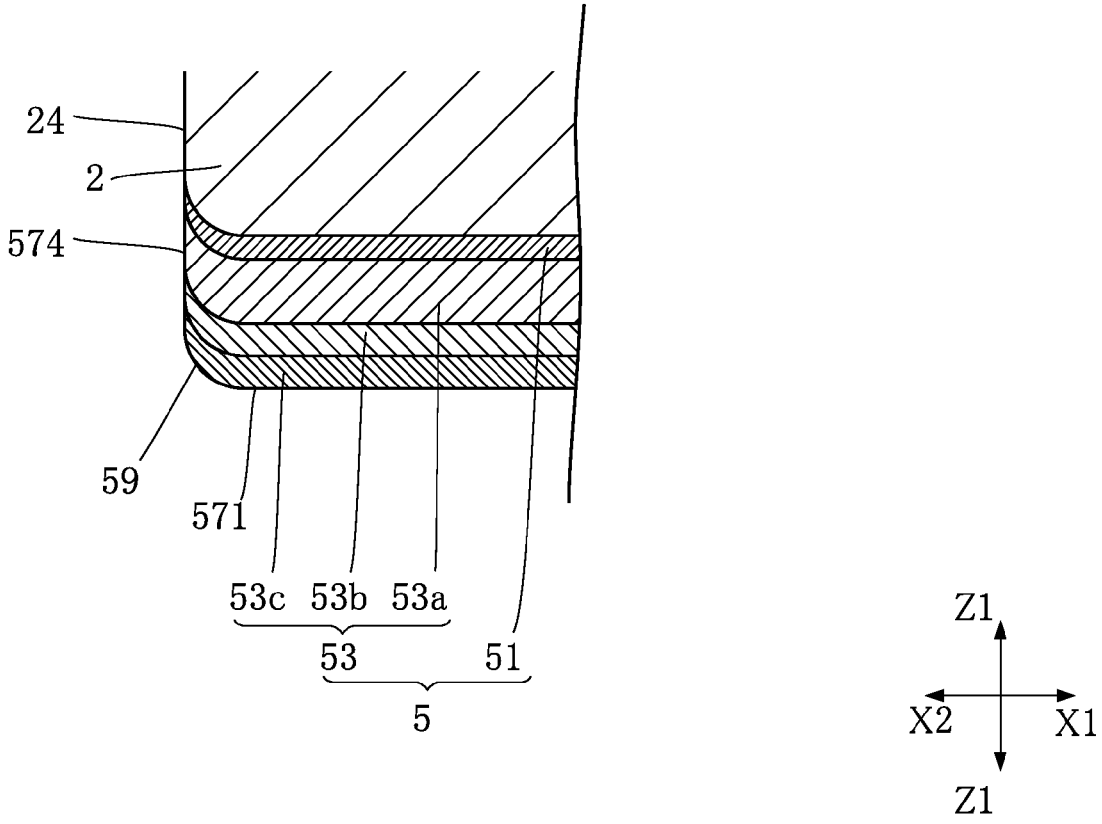
FIG. 9 illustrates a part of the chip resistor of FIG. 1 as enlarged.

FIG. 9 shows a portion of the chip resistor 101 of FIG. 1 as enlarged.

As illustrated in FIGS. 1, 4-7 and 9, the second electrode 5 has a second electrode obverse surface 571, an electrode side surface 574, an electrode end surface 575, an electrode end surface 576 and a second curved surface 59 (see FIG. 9). Illustration of the second curved surface 59 is omitted in the figures other than FIGS. 6 and 9.

The second-electrode obverse surface 571 faces in the same direction as the resistor board obverse surface 21 (i.e., downward in FIG. 1). The second-electrode obverse surface 571 is provided by the second plating layer 53 and specifically by the second outer plating film 53*c*.

The electrode side surface 574 faces in the second direction X2. In this embodiment, the electrode side surface 574 is flush with the resistor board second side surface 24. As illustrated in FIGS. 4 and 5, the electrode end surface 575 faces in the third direction X3. The electrode end surface 575 is flush with the resistor board first end surface 25. The electrode end surface 576 faces in the fourth direction X4. The electrode end surface 576 is flush with the resistor board second end surface 26. The electrode side surface 574, the electrode end surface 575 and the electrode end surface 576 are provided by the second underlying layer 51 and the second plating layer 53, and specifically provided by the second underlying layer 51, the second inner plating film 53*a*, the second intermediate plating film 53*b* and the second outer plating film 53*c*.

The second curved surface 59 is formed at the edges as viewed in the thickness direction Z1. In FIG. 6, the portions where the second curved surface 59 is formed are shaded. The second curved surface 59 is connected to the second-electrode obverse surface 571, the electrode side surface 574, the electrode end surface 575 and the electrode end surface 576. The second curved surface 59 is formed because punching is employed to make the chip resistor 101.

The protective layer 7 is formed on the resistor board reverse surface 22 of the resistor board 2. The protective layer 7 is made of an insulating material. Examples of the material include an epoxy-based material. The protective layer 7 is formed to protect the resistor board 2. For instance, the protective layer 7 is 20 to 40 μm in thickness. The protective layer 7 does not necessarily need to be formed.

A method for making the chip resistor 101 is briefly described.

Figure 10:
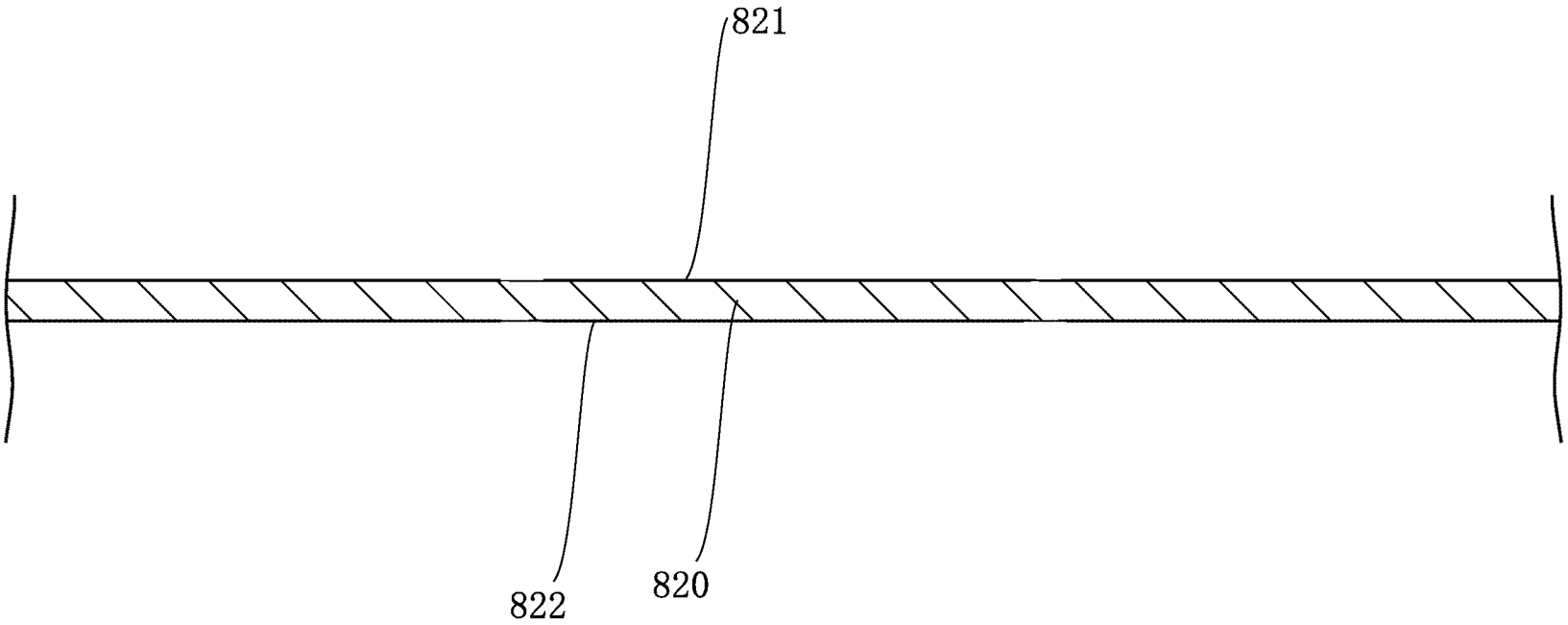
FIG. 10 is a sectional view illustrating a step of a method for making the chip resistor illustrated in FIG. 1.

First, a resistor board 820 is prepared, as illustrated in FIG. 10. The resistor board 820 is formed into the resistor board 2.

Figure 11:
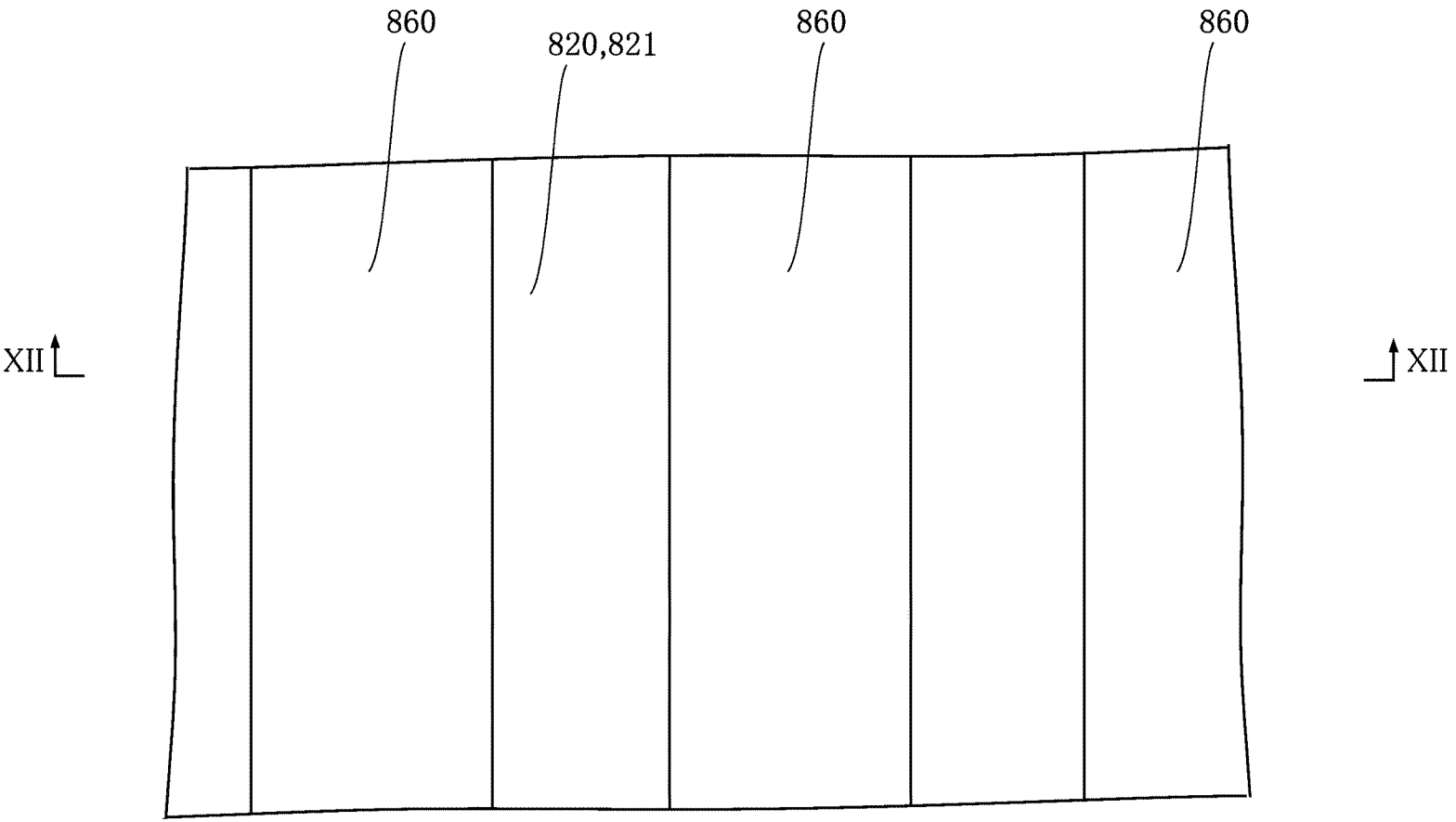
FIG. 11 is a plan view illustrating the step subsequent to the step of FIG. 10.
Figure 12:
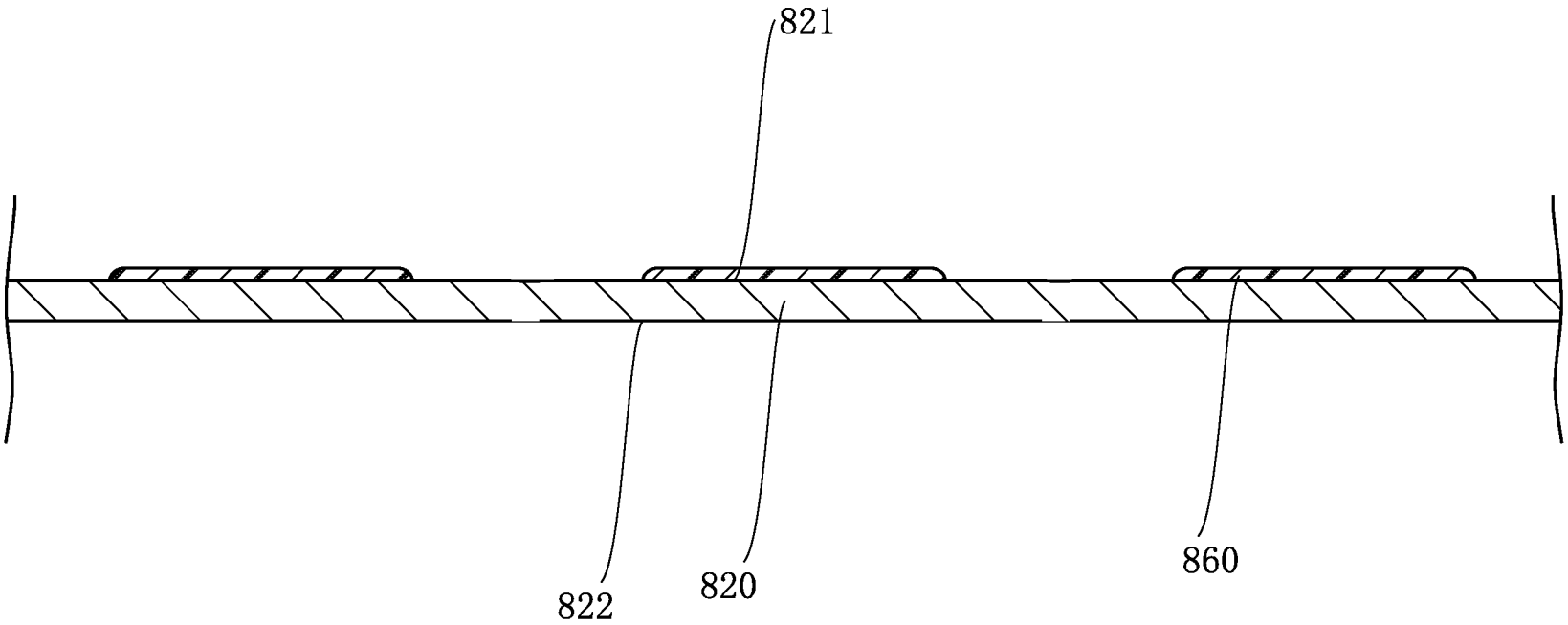
FIG. 12 is a sectional view taken along lines XII-XII in FIG. 11.

Then, as illustrated in FIGS. 11 and 12, an insulating layer 860 is formed on the resistor board obverse surface 821 of the resistor board 820. The insulating layer 860 is formed into the insulating layer 6. The insulating layer 860 is formed as a plurality of strips elongated in one direction. For instance, the insulating layer 860 is formed by printing or application.

Figure 13:
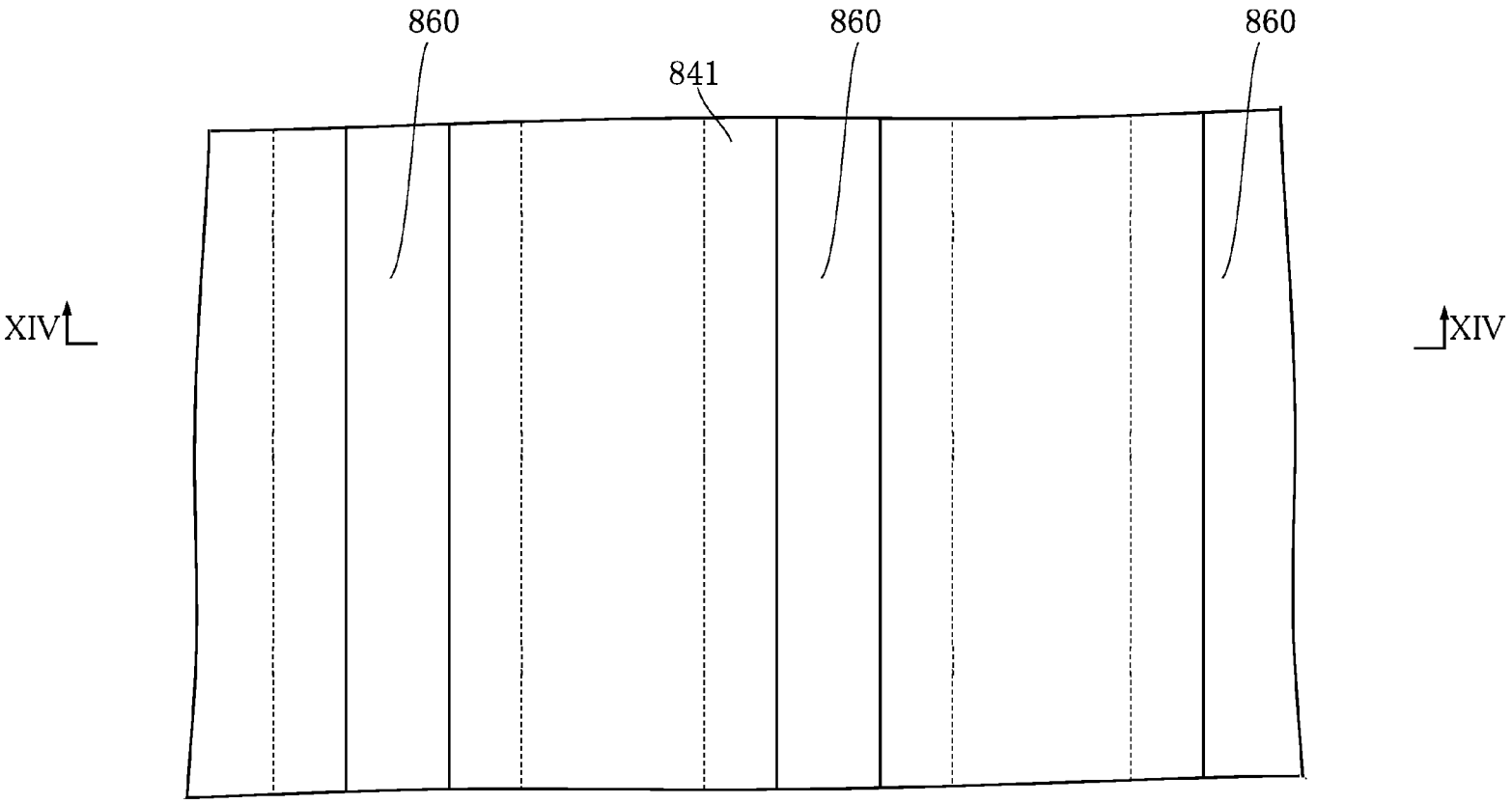
FIG. 13 is a plan view illustrating the step subsequent to the step of FIG. 11.
Figure 14:
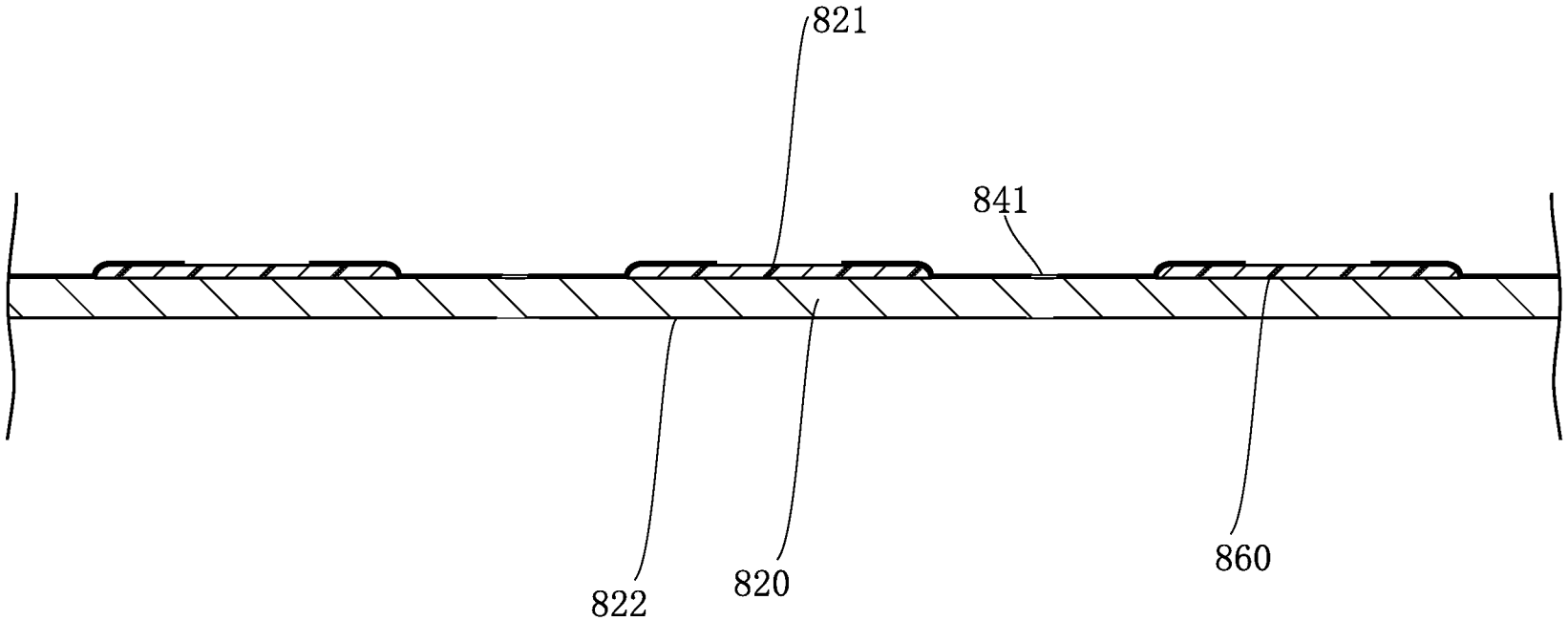
FIG. 14 is a sectional view taken along lines XIV-XIV in FIG. 13.

Then, as illustrated in FIGS. 13 and 14, an underlying layer 841 is formed on the resistor board 820. The underlying layer 841 is formed into the first underlying layer 41 or the second underlying layer 51. The underlying layer 841 is formed by PVD or CVD. For example, the underlying layer 841 may be formed by sputtering. In this process, the underlying layer 841 is formed in the form of a strip elongated in the same direction as the insulating layer 860. The underlying layer 841 is formed so as to expose a portion of the insulating layer 860. To form the underlying layer 841 in the form of a strip, masking may be employed. For instance, the underlying layer 841 is made of Ni or Cr.

Figure 15:
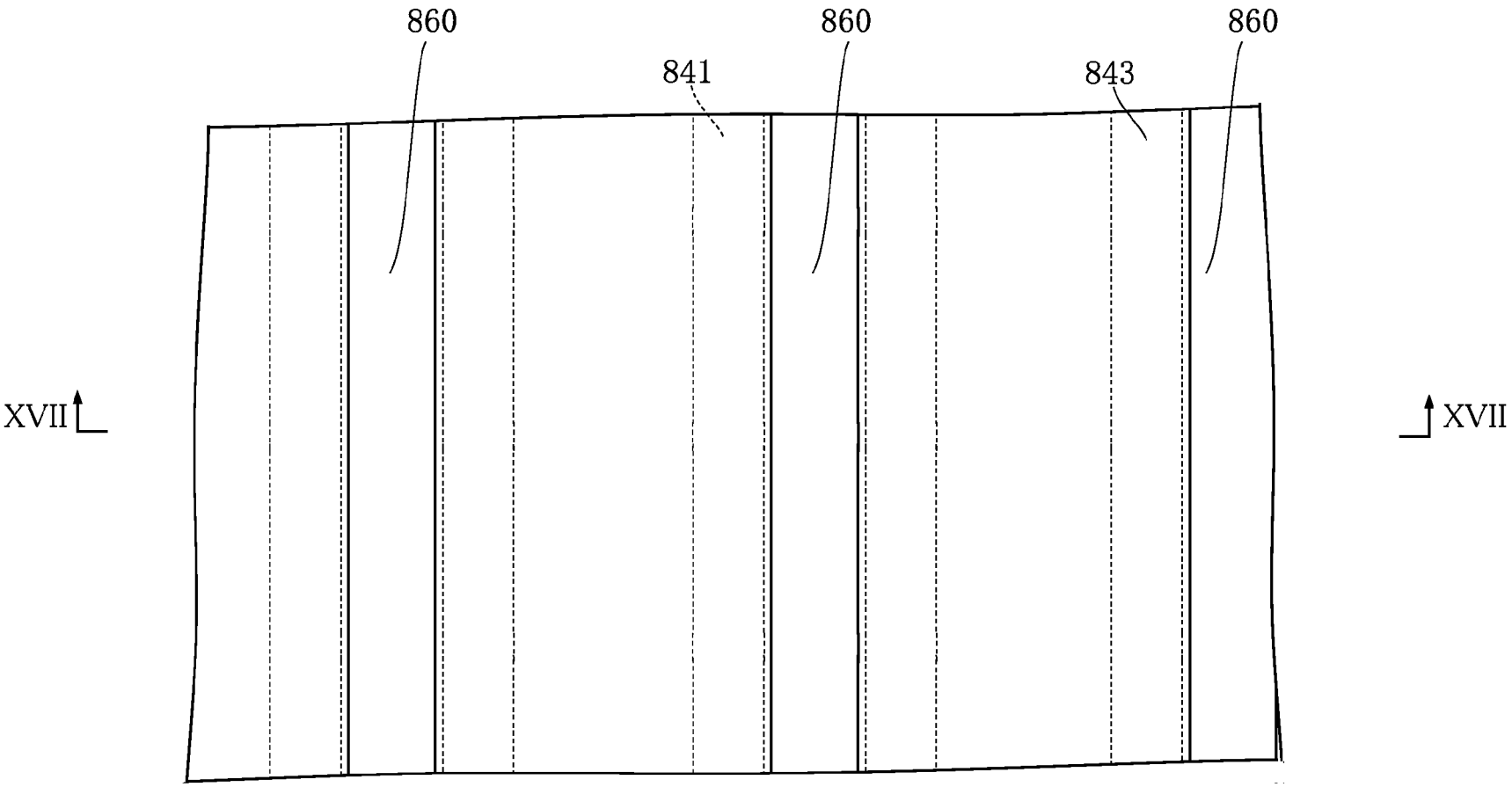
FIG. 15 is a plan view illustrating the step subsequent to the step of FIG. 13.
Figure 16:
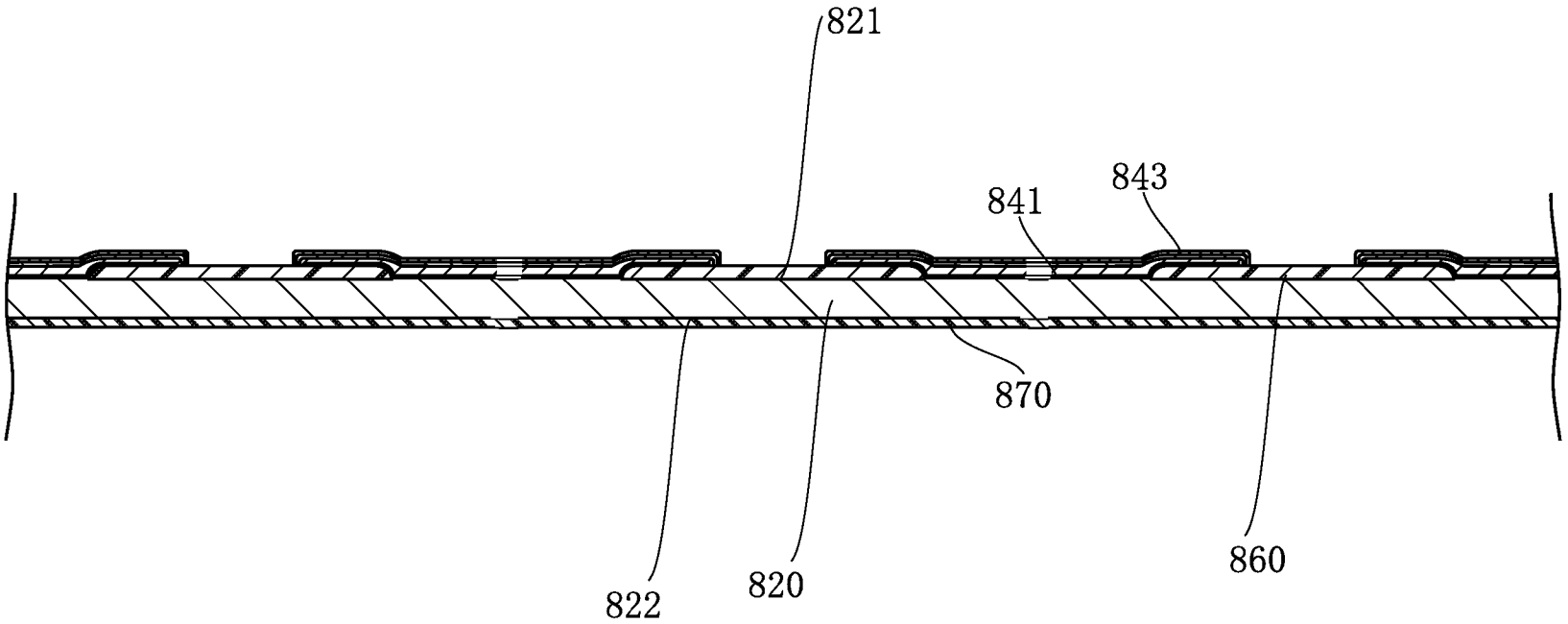
FIG. 16 is a sectional view taken along lines XVI-XVI in FIG. 15.

Then, as illustrated in FIGS. 15 and 16, a plating layer 843 is formed. The plating layer 843 is formed into the first plating layer 43 (first inner plating film 43*a*, first intermediate plating film 43*b*, the first outer plating film 43*c*) and the second plating layer 53 (second inner plating film 53*a*, second intermediate plating film 53*b*, the second outer plating film 53*c*). To form the plating layer 843, electroplating (barrel plating method) may be employed. Further, a protective layer 870 is formed on the resistor board reverse surface 822 of the resistor board 820. The protective layer 870 may be formed before the insulating layer 860 is formed on the resistor board obverse surface 821.

Figure 17:
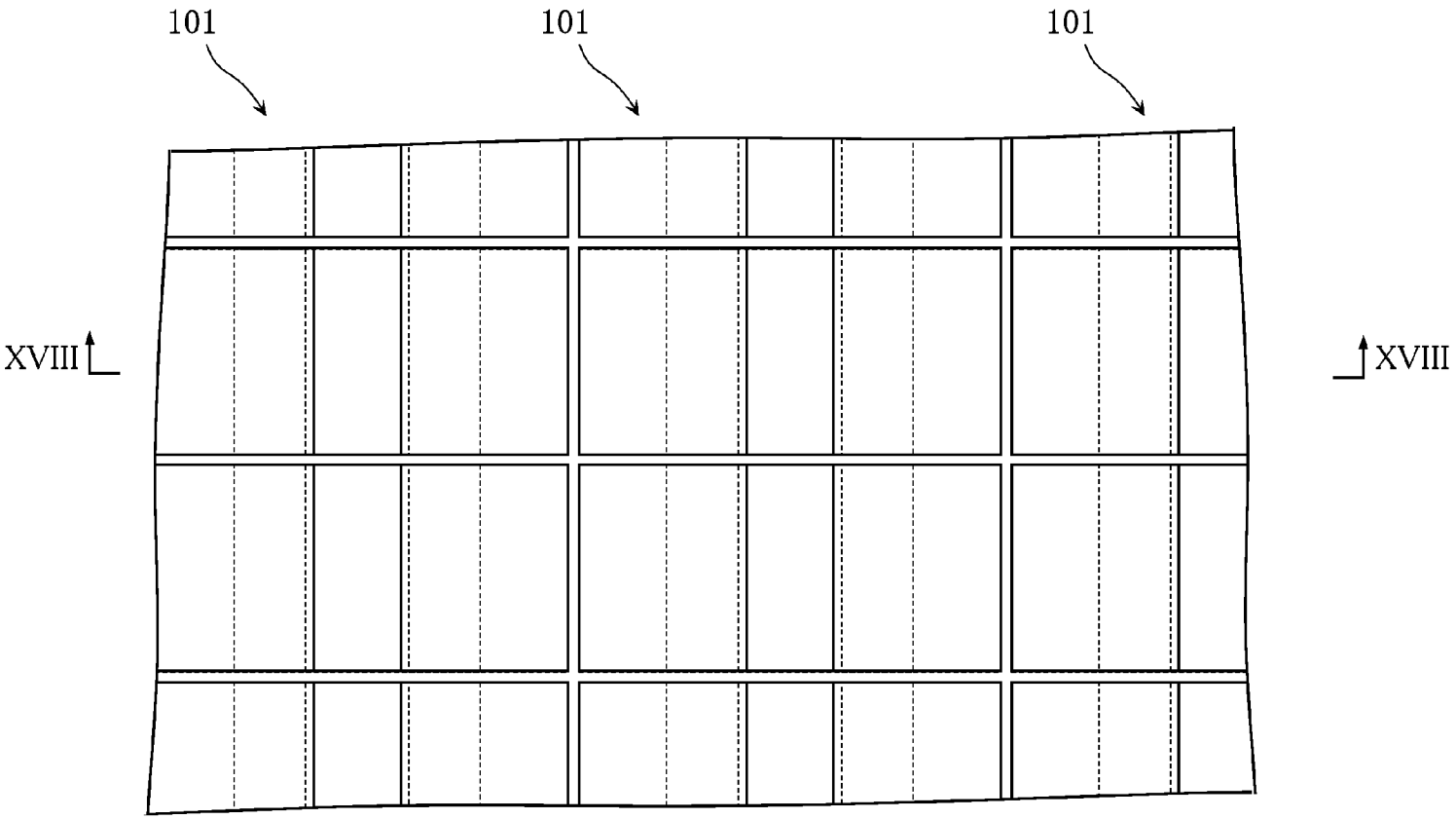
FIG. 17 is a plan view illustrating the step subsequent to the step of FIG. 15.
Figure 18:
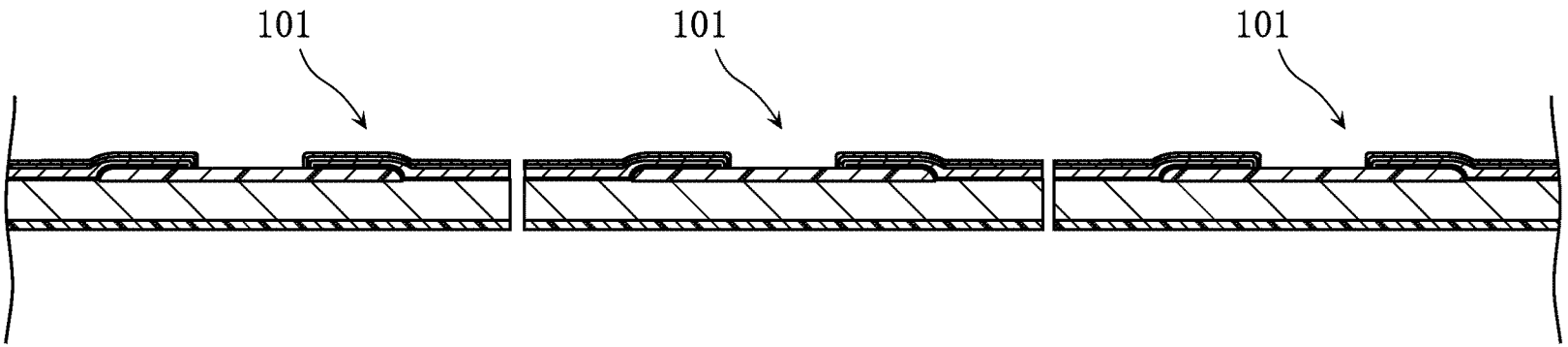
FIG. 18 is a sectional view taken along lines XVIII-XVIII in FIG. 17.

Then, the intermediate product illustrated in FIGS. 15 and 16 is cut as illustrated in FIGS. 17 and 18. This cutting may be performed by punching. By this punching, the above-described first curved surface 49 and second curved surface 59 are formed. Due to this cutting process, the resistor board first side surface 23 and the electrode side surface 473 become flush with each other, the resistor board second side surface 24 and the electrode side surface 574 become flush with each other. Further, the resistor board first end surface 25, the electrode end surface 475 and the electrode end surface 575 become flush with each other. Similarly, the resistor board second end surface 26, the electrode end surface 476 and the electrode end surface 576 become flush with each other. By the foregoing process, the chip resistor 101 is completed.

Advantages of this embodiment are described below.

In this embodiment, the chip resistor 101 has an insulating layer 6. The resistor board obverse surface 21 includes a first region 211 that is in contact with the first electrode 4, a second region 212 that is in contact with the second electrode 5 and an intermediate region 213 that is in contact with the insulating layer 6. The intermediate region 213 is disposed between the first region 211 and the second region 212 in the first direction X1. According to this arrangement, the resistance of the chip resistor 101 is determined by the dimension of the intermediate region 213 in the first direction X1. Thus, the dimensions of the first electrode 4 and the second electrode 5 in the first direction X1 can be determined regardless of the resistance of the chip resistor 101. In the chip resistor 101, the first underlying layer 41 is provided between the first plating layer 43 and the insulating layer 6 in the thickness direction Z1. This arrangement is suitable for increasing the dimension of the first plating layer 43 in the first direction X1. By increasing the dimension of the first plating layer 43 in the first direction X1, the heat dissipation efficiency of the chip resistor 101 can be enhanced.

Similarly, in the chip resistor 101, the second underlying layer 51 is provided between the second plating layer 53 and the insulating layer 6 in the thickness direction Z1. This arrangement is suitable for increasing the dimension of the second plating layer 53 in the second direction X2. By increasing the dimension of the second plating layer 53 in the second direction X2, the heat dissipation efficiency of the chip resistor 101 can be enhanced.

A second embodiment of the present invention is described below with reference to FIGS. 19-25.

In the description given below, the elements that are identical or similar to those of the foregoing embodiments are designated by the same reference signs as those used for the foregoing embodiments and the explanation is omitted appropriately.

Figure 19:
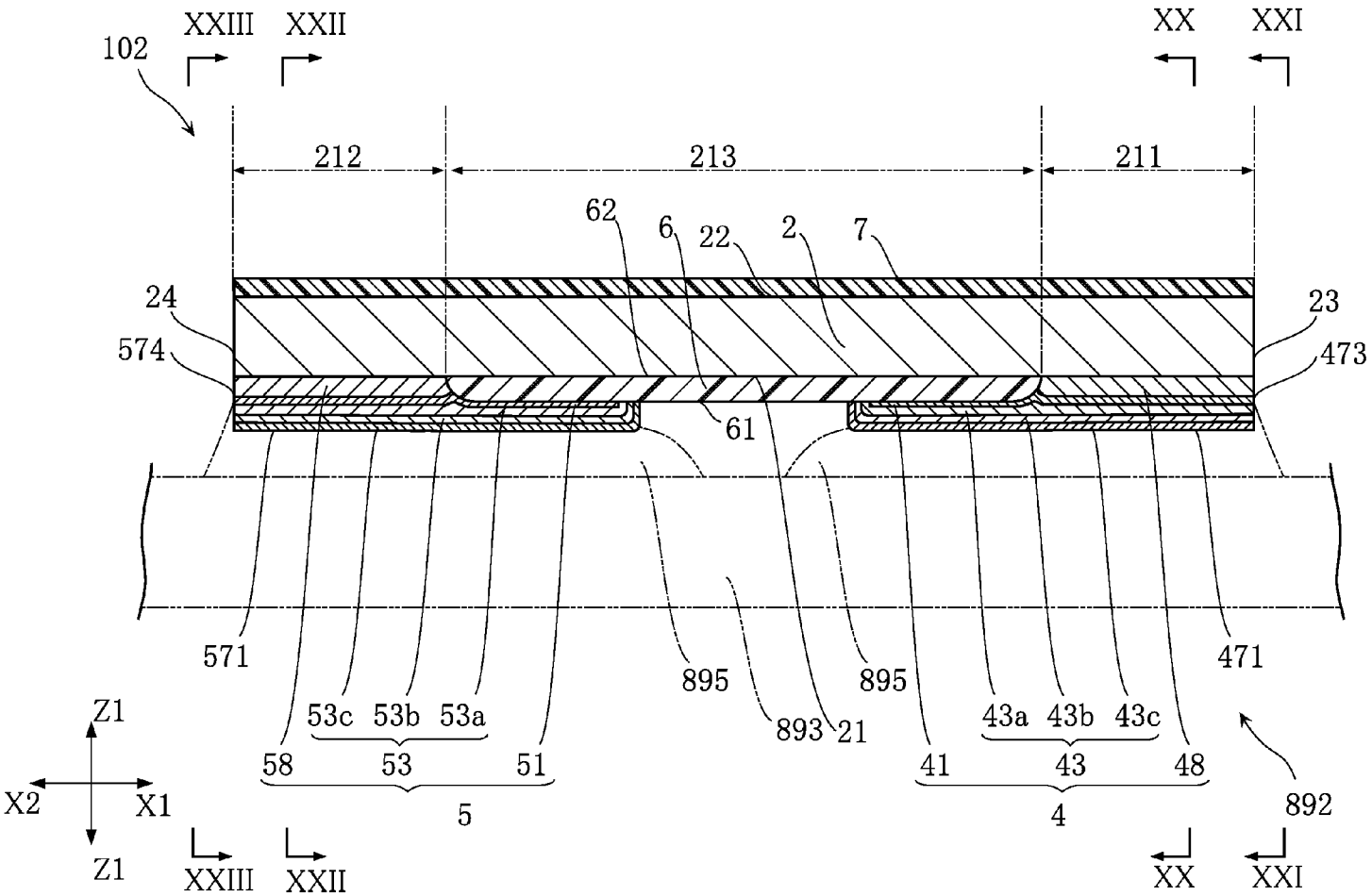
FIG. 19 is a sectional view illustrating a mounting structure of a chip resistor according to a second embodiment of the present invention.

FIG. 19 is a sectional view illustrating a mounting structure of a chip resistor according to a second embodiment of the present invention.

The chip resistor mounting structure 892 illustrated in the figure includes a chip resistor 102, a mount board 893 and an electroconductive bonding portion 895.

Since the structures of the mount board 893 and the electroconductive bonding portion 895 are the same as those of the first embodiment, explanation of these portions is omitted.

Figure 20:
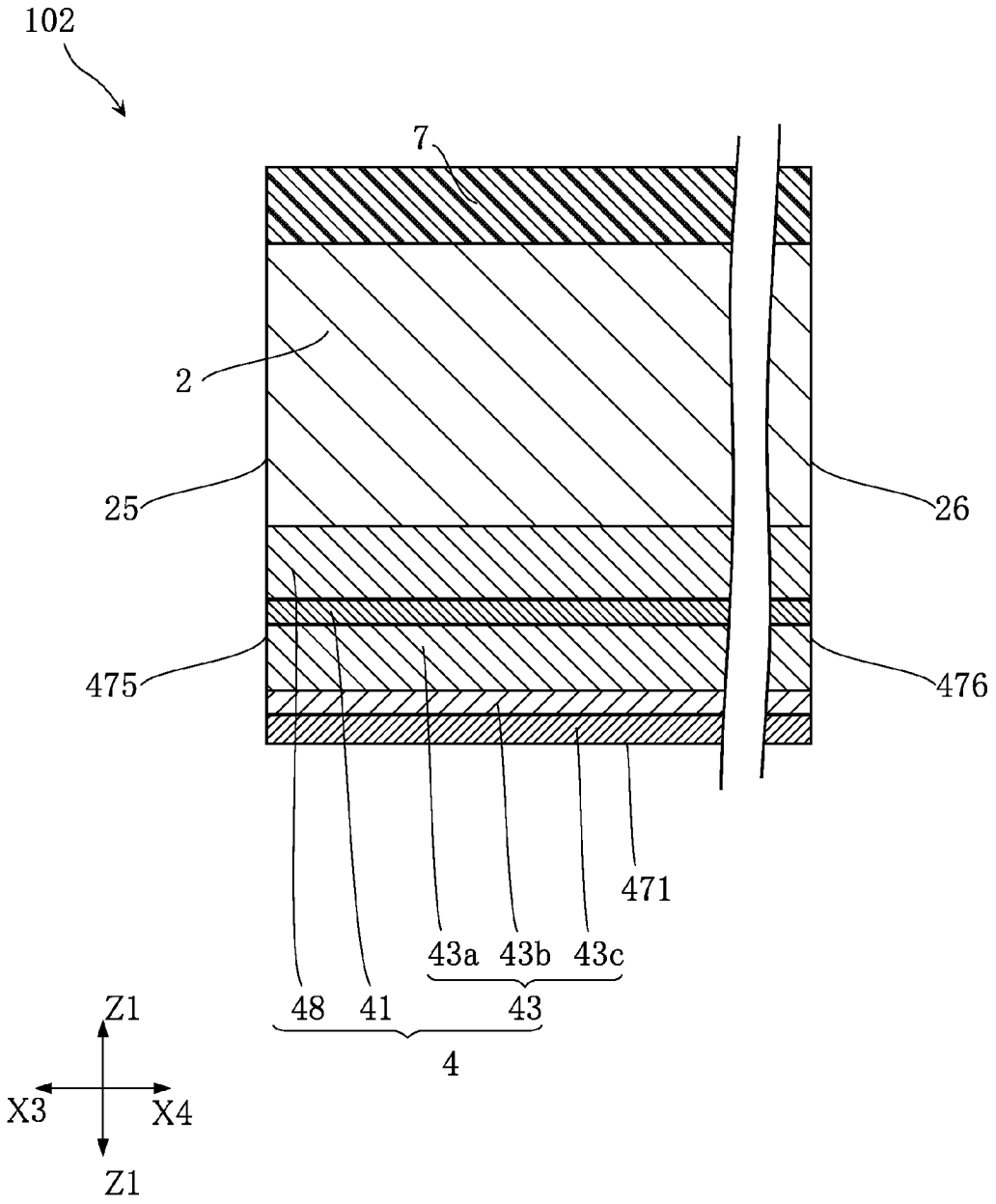
FIG. 20 is a sectional view of the chip resistor taken along lines XX-XX in FIG. 19.
Figure 21:
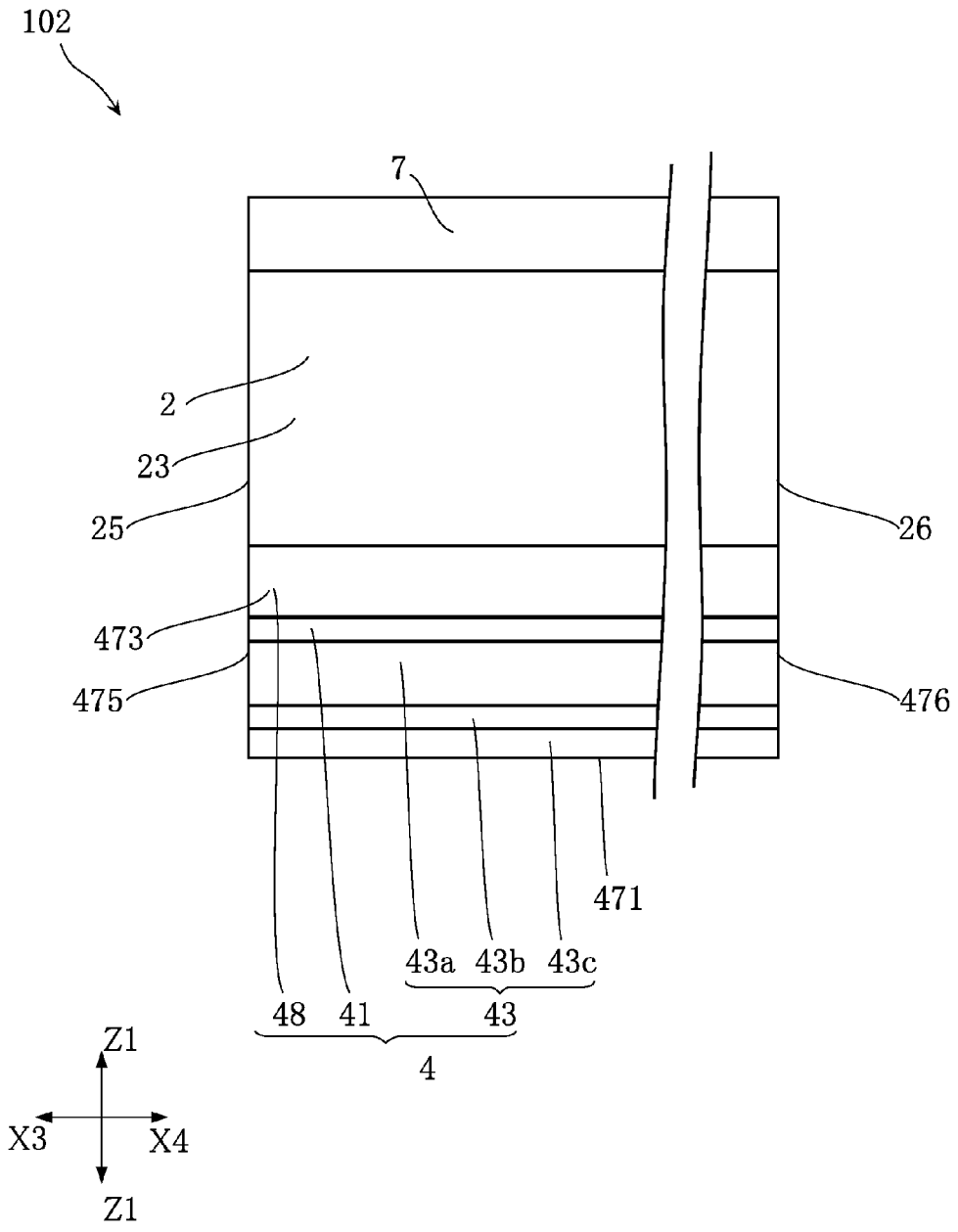
FIG. 21 illustrates the chip resistor as viewed in the direction of arrows XXI-XXI in FIG. 19.
Figure 22:
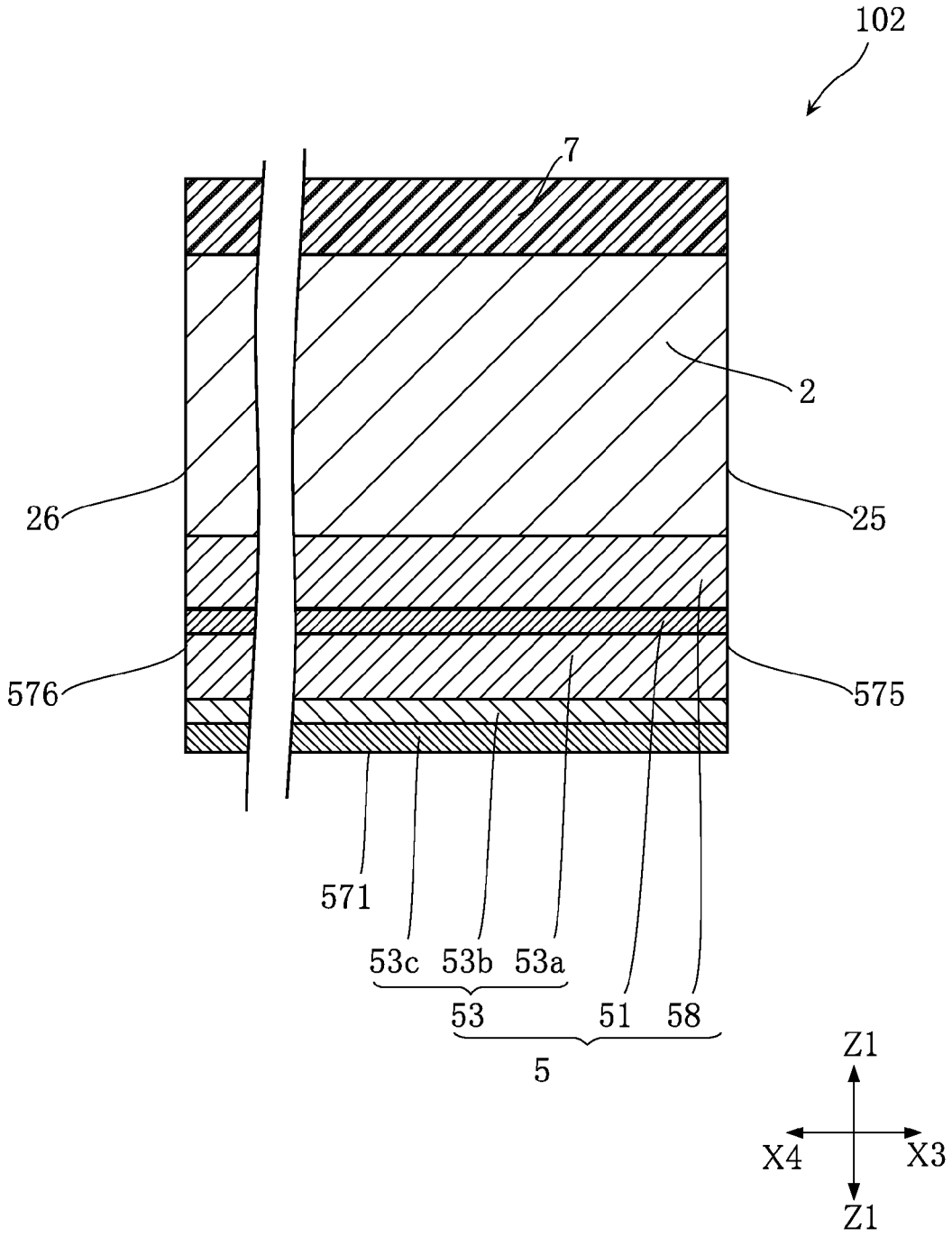
FIG. 22 is a sectional view of the chip resistor taken along lines XXII-XXII in FIG. 19.
Figure 23:
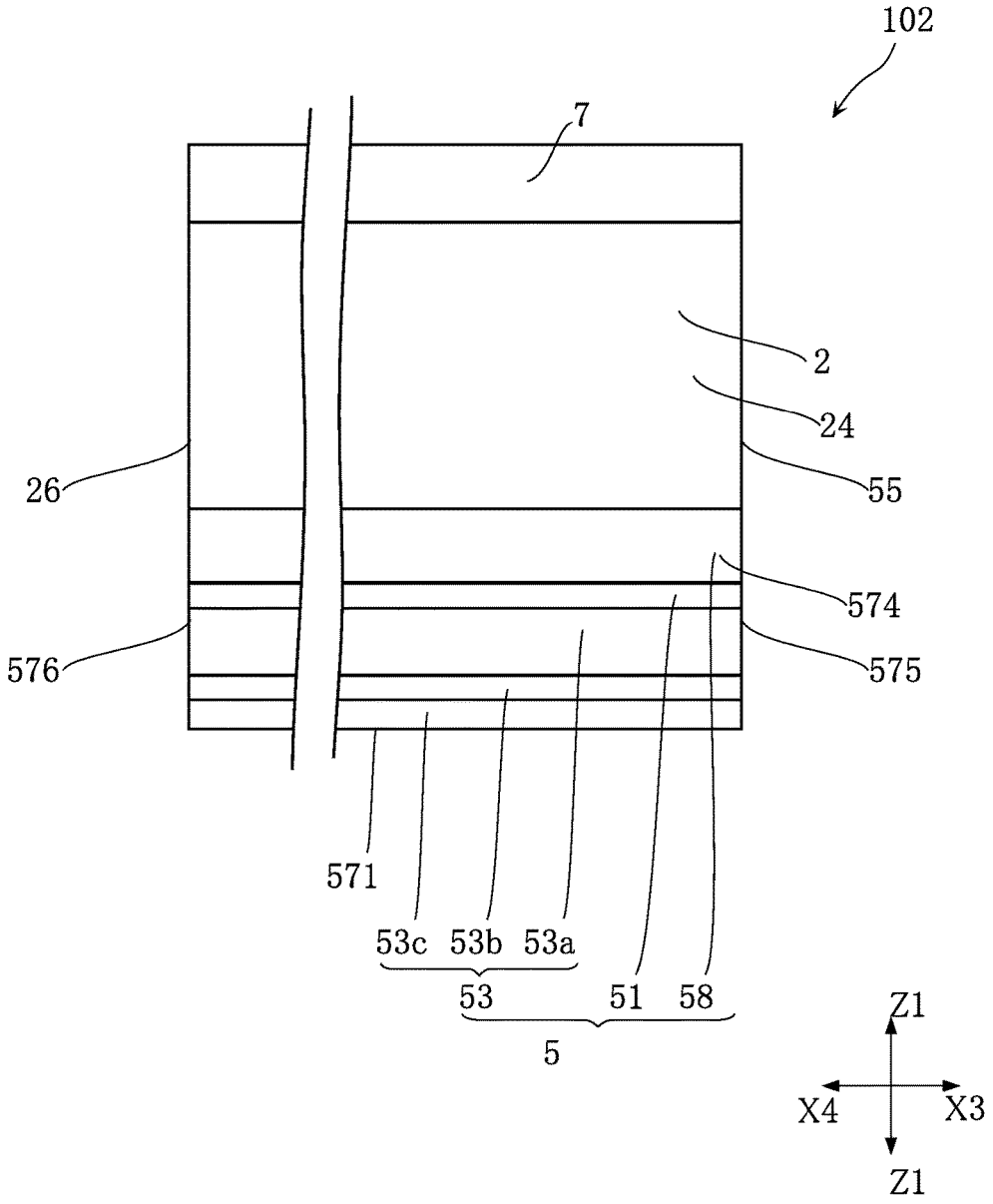
FIG. 23 illustrates the chip resistor as viewed in the direction of arrows XXIII-XXIII in FIG. 19.
Figure 24:
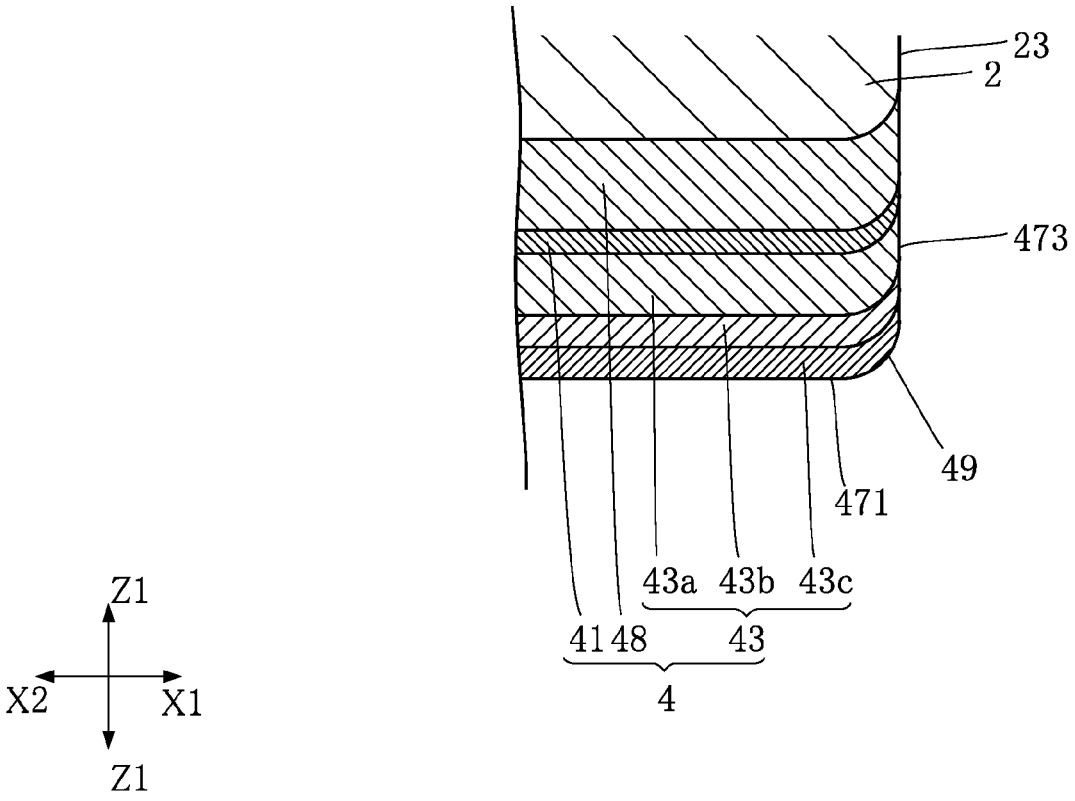
FIG. 24 illustrates a part of the chip resistor of FIG. 19 as enlarged.
Figure 25:
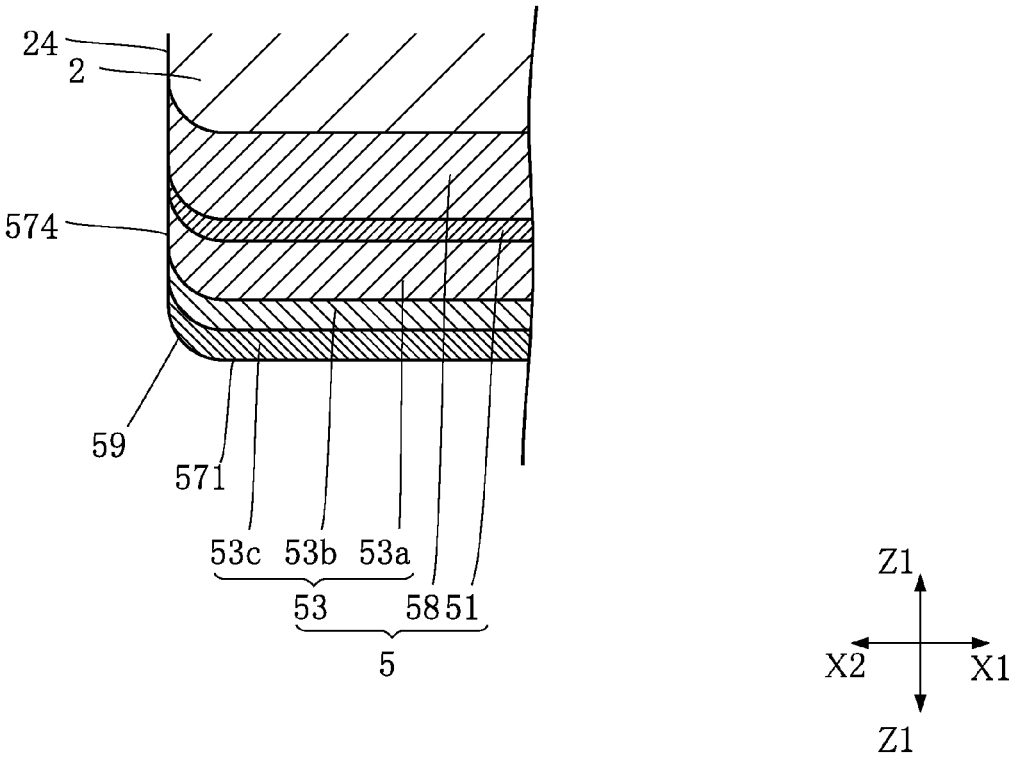
FIG. 25 illustrates a part of the chip resistor of FIG. 19 as enlarged.

FIG. 20 is a sectional view of the chip resistor taken along lines XX-XX in FIG. 19. FIG. 21 illustrates the chip resistor as viewed in the direction of arrows XXI-XXI in FIG. 19. FIG. 22 is a sectional view of the chip resistor taken along lines XXII-XXII in FIG. 19. FIG. 23 illustrates the chip resistor as viewed in the direction of arrows XXIII-XXIII in FIG. 19. FIG. 24 illustrates a part of the chip resistor of FIG. 19 as enlarged. FIG. 25 illustrates a part of the chip resistor of FIG. 19 as enlarged.

The chip resistor 102 shown in these figures includes a resistor board 2, a first electrode 5, a second electrode 5, an insulating layer 6 and a protective layer 7.

Since the structures of the resistor board 2, the insulating layer 6 and the protective layer 7 are the same as those of the first embodiment, explanation of these is omitted.

The first electrode 4 is electrically connected to the resistor board 2. The first electrode 4 is used to supply electric power to the resistor board 2 from the mount board 893 on which the chip resistor 102 is mounted. The first electrode 4 is in contact with the resistor board 2 and the insulating layer 6. In this embodiment, the first electrode 4 is in contact with the resistor board obverse surface 21 of the resistor board 2. In this embodiment, a part of the insulating layer 6 is disposed between the first electrode 4 and the resistor board 2. As illustrated in FIG. 19, in the mounting structure 892, the first electrode 4 is in contact with the electroconductive bonding portion 895 and electrically connected to a wiring pattern (not shown) of the mount board 893 via the electroconductive bonding portion 395.

The first electrode 4 includes a first underlying layer 41, a first plating layer 43 and a first electroconductive layer 48.

The first electroconductive layer 48 is in contact with the resistor board 2. The first electroconductive layer 48 is in contact with a portion of the resistor board obverse surface 21 which is exposed from the insulating layer 6. Specifically, the first electroconductive layer 48 is in contact with the first region 211 of the resistor board obverse surface 21. In this embodiment, the first electroconductive layer 58 is formed by plating (rack plating). For instance, the first electroconductive layer 48 is made of Cu. The first electroconductive layer 48 is thicker than the first underlying layer 41. As illustrated in FIGS. 19-21, the first electroconductive layer 48 is exposed in the first direction X1, the third direction X3 and the fourth direction X4.

The first underlying layer 41 serves as the base for forming the first plated layer 43 on the insulating layer 6 by a plating method. The first underlying layer 41 includes a portion spaced apart from the resistor board 2 in the thickness direction Z1. In the thickness direction Z1, the first underlying layer 41 is disposed between the first plating layer 43 and the insulating layer 6. The insulating layer 6 is disposed between the first underlying layer 41 and the resistor board 2. The first underlying layer 41 includes a portion that overlaps the first region 211 and the intermediate region 213 as viewed in the thickness direction Z1.

As illustrate in FIGS. 19-21, the side surfaces of the first underlying layer 41 are exposed. Specifically, in the chip resistor 102, the first underlying layer 41 is exposed in the first direction X1, the third direction X3 and the fourth direction X4.

In order that the chip resistor 102 has good heat dissipation efficiency, it is preferable that the dimension of the first underlying layer 41 in the first direction X1 is large. Preferably, the dimension of the first underlying layer 41 in the first direction X1 is not smaller than one fourth of the dimension of the resistor board 2 in the first direction X1 and more preferably not smaller than one third of the dimension of the resistor board 2 in the first direction X1. The thickness of the first underlying layer 41 is smaller than the thicknesses of the insulating layer 6 and the first plating layer 43. The first underlying layer 41 can be formed by PVD (Physical Vapor Deposition), CVD (Chemical Vapor Deposition) or printing. In this embodiment, the first underlying layer 41 is formed by PVD, in particular by sputtering. The first underlying layer 41 is e.g. 100 to 500 nm in thickness. For instance, the first underlying layer 41 contains Ni or Cr.

Since the first plating layer 43 is similar to that of the first embodiment, the explanation is omitted.

As illustrated in FIGS. 19-21 and 24, the first electrode 4 has a first electrode obverse surface 471, an electrode side surface 473, an electrode end surface 475 (electrode first end surface), an electrode end surface 476 (electrode second end surface) and a first curved surface 49.

The first electrode obverse surface 471 faces in the same direction as the resistor board obverse surface 21 (i.e., downward in FIG. 19). The first electrode obverse surface 471 is provided by the first plating layer 43 and specifically by the first outer plating film 43*c*.

The electrode side surface 473 faces in the first direction X1. In this embodiment, the electrode side surface 473 is flush with the resistor board first side surface 23. As illustrated in FIGS. 20 and 21, the electrode end surface 475 faces in the third direction X3. The electrode end surface 475 is flush with the resistor board first end surface 25. The electrode end surface 476 faces in the fourth direction X4. The electrode end surface 476 is flush with the resistor board second end surface 26. The electrode side surface 473, the electrode end surface 475 and the electrode end surface 476 are provided by the first underlying layer 41, the first plating layer 43 and the first electroconductive layer 48 and specifically provided by the first underlying layer 41, the first inner plating film 43*a*, the first intermediate plating film 43*b*, the first outer plating film 43*c* and the first electroconductive layer 48.

The first curved surface 49 is formed at the edges as viewed in the thickness direction Z1. The first curved surface 49 is connected to the first electrode obverse surface 471, the electrode side surface 473, the electrode end surface 475 and the electrode end surface 476. The first curved surface 49 is formed because punching is employed to make the chip resistor 102.

The second electrode 5 is offset from the first electrode 4 in the second direction X2. The second electrode 5 is electrically connected to the resistor board 2. The second electrode 5 is used to supply electric power to the resistor board 2 from the mount board 893 on which the chip resistor 102 is mounted. The second electrode 5 is in contact with the resistor board 2 and the insulating layer 6. In this embodiment, the second electrode 5 is in contact with the resistor board obverse surface 21 of the resistor board 2. In this embodiment, a part of the insulating layer 6 is disposed between the second electrode 5 and the resistor board 2. As illustrated in FIG. 19, in the mounting structure 892, the second electrode 5 is in contact with the electroconductive bonding portion 895 and electrically connected to a wiring pattern (not shown) of the mount board 893 via the electroconductive bonding portion 895.

The second electrode 5 includes a second underlying layer 51, a second plating layer 53 and a second electroconductive layer 58.

The second electroconductive layer 58 is in contact with the resistor board 2. The second electroconductive layer 58 is in contact with a portion of the resistor board obverse surface 21 which is exposed from the insulating layer 6. Specifically, the second electroconductive layer 58 is in contact with the first region 211 of the resistor board obverse surface 21. In this embodiment, the second electroconductive layer 58 is formed by plating. For instance, the second electroconductive layer 58 is made of Cu. The second electroconductive layer 58 is thicker than the second underlying layer 51. The second electroconductive layer 58 is exposed in the second direction X2, the third direction X3 and the fourth direction X4.

The second underlying layer 51 serves as the base for forming the second plated layer 53 on the insulating layer 6 by a plating method. The second underlying layer 51 includes a portion spaced apart from the resistor board 2 in the thickness direction Z1. In the thickness direction Z1, the second underlying layer 51 is disposed between the second plating layer 53 and the insulating layer 6. The insulating layer 6 is disposed between the second underlying layer 51 and the resistor board 2. The second underlying layer 51 includes a portion that overlaps the second region 212 and the intermediate region 213 as viewed in the thickness direction Z1.

As illustrate in FIGS. 19, 22 and 23, the side surfaces of the second underlying layer 51 are exposed. Specifically, in the chip resistor 102, the second underlying layer 51 is exposed in the second direction X2, the third direction X3 and the fourth direction X4.

In order that the chip resistor 102 has good heat dissipation efficiency, it is preferable that the dimension of the second underlying layer 51 in the second direction X2 is large. Preferably, the dimension of the second underlying layer 51 in the second direction X2 is not smaller than one fourth of the dimension of the resistor board 2 in the second direction X2 and more preferably not smaller than one third of the dimension of the resistor board 2 in the second direction X2. The thickness of the second underlying layer 51 is smaller than the thicknesses of the insulating layer 6 and the second plating layer 53. The second underlying layer 51 can be formed by PVD (Physical Vapor Deposition), CVD (Chemical Vapor Deposition) or printing. In this embodiment, the second underlying layer 51 is formed by PVD, in particular by sputtering. The second underlying layer 51 is e.g. 100 to 500 nm in thickness. For instance, the second underlying layer 51 contains Ni or Cr.

Since the second plating layer 53 is similar to that of the first embodiment, the explanation is omitted.

As illustrated in FIGS. 19, 22, 23 and 25, the second electrode 5 has a second electrode obverse surface 571, an electrode side surface 573, an electrode end surface 575, an electrode end surface 576 and a second curved surface 59.

The second electrode obverse surface 571 faces in the same direction as the resistor board obverse surface 21 (i.e., downward in FIG. 19). The second electrode obverse surface 571 is provided by the second plating layer 53 and specifically by the second outer plating film 53*c*.

The electrode side surface 574 faces in the second direction X2. In this embodiment, the electrode side surface 574 is flush with the resistor board second side surface 24. As illustrated in FIGS. 22 and 23, the electrode end surface 575 faces in the third direction X3. The electrode end surface 575 is flush with the resistor board first end surface 25. The electrode end surface 576 faces in the fourth direction X4. The electrode end surface 576 is flush with the resistor board second end surface 26. The electrode side surface 574, the electrode end surface 575 and the electrode end surface 576 are provided by the second underlying layer 51, the second plating layer 53 and the second electroconductive layer 58 and specifically provided by the second underlying layer 51, the second inner plating film 53*a*, the second intermediate plating film 53*b*, the second outer plating film 53*c* and the second electroconductive layer 58.

The second curved surface 59 is formed at the edges as viewed in the thickness direction Z1. The second curved surface 59 is connected to the second electrode obverse surface 571, the electrode side surface 574, the electrode end surface 575 and the electrode end surface 576. The second curved surface 59 is formed because punching is employed to make the chip resistor 102.

This embodiment provides the following advantages, in addition to the advantages of the first embodiment.

In this embodiment, the first electrode 4 includes a first electroconductive layer 48 between the first plating layer 43 and the resistor board 2. The first electroconductive layer 48 is in contact with the first region 211. According to this arrangement, the portion of the first electrode obverse surface 471 which overlaps the first region 211 as viewed in the thickness direction Z1 is disposed low in FIG. 19 so that the first electrode obverse surface 471 is flat. When the first electrode obverse surface 471 is flat, the chip resistor 102 can be easily mounted on the mount board 893.

Similarly, in this embodiment, the second electrode 5 includes a second electroconductive layer 58 between the second plating layer 53 and the resistor board 2. The second electroconductive layer 58 is in contact with the second region 212. According to this arrangement, the portion of the second electrode obverse surface 571 which overlaps the second region 212 as viewed in the thickness direction Z1 is disposed low in FIG. 19 so that the second-electrode obverse surface 571 is flat. When the second-electrode obverse surface 571 is flat, the chip resistor 102 can be easily mounted on the mount board 893.

The present invention is not limited to the foregoing embodiments. The specific structure of each part of the present invention can be varied in design in many ways.

The invention claimed is:

1. A method of making a chip resistor, the method comprising the steps of:

forming an insulating layer on an obverse surface of a resistor board;

forming a conducting layer that flanks the insulating layer on the obverse surface of the resistor;

forming an electroconductive underlying layer on the obverse surface of the resistor board on which the conducting layer was formed, in a manner such that the underlying layer covers a part of the insulating layer;

forming a plating layer on the obverse surface of the resistor board in a manner such that the plating layer covers the underlying layer; and collectively cutting through the plating layer, the underlying layer and the resistor board at a position spaced apart from the insulating layer as viewed in a thickness direction of the resistor board.

2. The method according to claim 1, wherein the conductive layer is in direct contact with the obverse surface of the resistor board, and in the cutting step the conductive layer is cut collectively with the resistor board, the underlying layer and the plating layer.

3. The method according to claim 1, wherein the conductive layer is greater in thickness than the underlying layer.

4. The method according to claim 1, wherein the plating layer has a flat surface that is parallel to the obverse surface of the resistor board and overlaps with the insulating layer and the conductive layer as viewed in the thickness direction of the resistor board.

5. The method according to claim 1, wherein the underlying layer is in direct contact with the insulating layer.

6. The method according to claim 1, wherein the plating layer comprises an inner plating film and an outer plating film, the inner plating film being disposed between the outer plating film and the underlying layer, the inner plating film is made of one of Cu, Ag or Au, and the outer plating film is made of Sn.

7. The method according to claim 6, wherein the plating layer comprises an intermediate plating film that is made of Ni and disposed between the inner plating film and the outer plating film.

8. The method according to claim 1, wherein the underlying layer is made of one of Ni or Cr.

9. The method according to claim 1, wherein the underlying layer is smaller in thickness than each of the insulating layer and the plating layer.

10. The method according to claim 1, wherein the underlying layer is formed by sputtering.

11. The method according to claim 1, wherein the collective cutting is performed by punching.

12. The method according to claim 1, further comprising the step of forming a protective layer on a reverse surface of the resistor board that is opposite to the obverse surface.

13. The method according to claim 12, wherein the step of forming the protective layer is performed before the collective cutting.

14. The method according to claim 12, wherein the protective layer is made of an epoxy-based material.

15. The method according to claim 1, wherein the resistor board is made of one of manganin, zeranin, Ni—Cr alloy, Cu—Ni alloy or Fe—Cr alloy.

16. The method according to claim 1, wherein the insulating layer has a thermal conductivity of 1.0 to 5.0 W/(m·K).

17. The method according to claim 1, wherein the insulating layer has an elongated rectangular shape as viewed in the thickness direction of the resistor board and a width of the insulating layer is constant along a longitudinal direction of the insulating layer.

18. The method according to claim 17, wherein the insulating layer comprises a central portion elongated in the longitudinal direction and two marginal portions flanking the central portion, the two marginal portions being covered by the underlying layer, the central portion being exposed from the underlying layer.

19. The method according to claim 18, wherein the plating layer is in contact with a part of the central portion of the insulating layer.

* * * * *